US007809321B2

(12) United States Patent
Yano et al.

(10) Patent No.: US 7,809,321 B2
(45) Date of Patent: Oct. 5, 2010

(54) CLEANING DEVICE, PROCESS CARTRIDGE AND IMAGE FORMING APPARATUS

(75) Inventors: Hidetoshi Yano, Kanagawa (JP); Osamu Naruse, Kanagawa (JP); Kenji Sugiura, Kanagawa (JP); Naomi Sugimoto, Kanagawa (JP); Yasayuki Yamashita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 301 days.

(21) Appl. No.: 11/866,518

(22) Filed: Oct. 3, 2007

(65) Prior Publication Data

US 2008/0253815 A1 Oct. 16, 2008

(30) Foreign Application Priority Data

Oct. 6, 2006 (JP) ..... 2006-275702

(51) Int. Cl.
*G03G 21/00* (2006.01)

(52) U.S. Cl. ..... 399/353

(58) Field of Classification Search ..... 399/343–345, 399/349–351, 353–355
See application file for complete search history.

(56) References Cited

U.S. PATENT DOCUMENTS

| | | | | |
|---|---|---|---|---|
| 5,905,932 | A * | 5/1999 | Morse et al. | 399/353 |
| 7,184,699 | B2 | 2/2007 | Naruse et al. | |
| 2001/0038764 | A1* | 11/2001 | Kubo | 399/350 |
| 2003/0002892 | A1* | 1/2003 | Saito et al. | 399/302 |
| 2003/0118383 | A1* | 6/2003 | Endo et al. | 399/350 |
| 2005/0058918 | A1 | 3/2005 | Kurimoto et al. | |
| 2005/0100375 | A1 | 5/2005 | Naruse et al. | |
| 2005/0118518 | A1 | 6/2005 | Ikegami et al. | |
| 2006/0133872 | A1 | 6/2006 | Sugiura et al. | |
| 2006/0240346 | A1 | 10/2006 | Toda et al. | |
| 2007/0042281 | A1 | 2/2007 | Orito et al. | |
| 2007/0059617 | A1 | 3/2007 | Toda et al. | |
| 2008/0170878 | A1* | 7/2008 | Yamashita et al. | 399/99 |
| 2008/0193178 | A1* | 8/2008 | Sugimoto et al. | 399/354 |
| 2008/0193179 | A1* | 8/2008 | Sugimoto et al. | 399/354 |
| 2009/0035038 | A1* | 2/2009 | Sugimoto et al. | 399/354 |
| 2009/0092428 | A1* | 4/2009 | Yano et al. | 399/349 |

FOREIGN PATENT DOCUMENTS

| | | |
|---|---|---|
| JP | 63-219624 | 9/1988 |
| JP | 01-183520 | 7/1989 |
| JP | 01-213411 | 8/1989 |
| JP | 01-292116 | 11/1989 |
| JP | 10-131035 | 5/1998 |
| JP | 10-310974 | 11/1998 |
| JP | 2005-265907 | 9/2005 |

OTHER PUBLICATIONS

U.S. Appl. No. 12/184,554, filed Aug. 1, 2008, Sugimoto, et al.

* cited by examiner

*Primary Examiner*—David M Gray
*Assistant Examiner*—Ruth N Labombard
(74) *Attorney, Agent, or Firm*—Oblon, Spivak, McClelland, Maier & Neustadt, L.L.P.

(57) ABSTRACT

A cleaning brush configured to remove toner from a surface of a member of an image forming apparatus; wherein the cleaning brush includes a plurality of fibers having an inside part formed from a conductive material and a surface part formed by an insulating material.

19 Claims, 19 Drawing Sheets

HIGH TEMPERATURE / HIGH HUMIDITY

LOW TEMPERATURE / LOW HUMIDITY

CLEANING DEVICE, PROCESS CARTRIDGE AND IMAGE FORMING APPARATUS

CROSS-REFERENCE TO RELATED APPLICATIONS

The present application claims priority to Japanese patent application no. 2006-275702, filed in the Japan Patent Office on Oct. 6, 2006, the disclosure of which is incorporated by reference herein in its entirety.

BACKGROUND OF THE INVENTION

1. Field of the Invention

The present invention relates to a cleaning device, and an image forming apparatus and a process cartridge that includes the cleaning device.

2. Discussion of Background

Japan Laid-Open Patent Publication no. 2005-265907 describes an electrostatic brush cleaning method which has a good ability to clean toners of small particle size or toner balls restrains mechanical contact between the electrostatic brush and a photosensitive member, and can reduce a surface film wear of the photosensitive member. The electrostatic brush cleaning method uses a conductive brush contacting a surface of the photosensitive member. A collecting roller contacts the conductive brush and a cleaning member removes toners on the surface of the collecting roller. A voltage is applied to only the conductive brush or both the conductive brush and the collecting roller. The toners on the surface of the photosensitive member are removed by both frictional force and electrostatic force. Thus, the electrostatic brush cleaning method has the good ability of cleaning toners of small particle size or toner balls.

The electrostatic brush cleaning method removes the toners, which are charged with a polarity that is opposite to a polarity of voltage which is applied on the conductive brush, from the surface of the photosensitive member by frictional force and electrostatic force.

SUMMARY OF THE INVENTION

However, we discovered that charge injection occurs from the conductive brush to the toners. The toners are charged with the same polarity as a polarity of the voltage applied to the conductive brush. Thus, the conductive brush can not remove the toners and the toners pass a nip between the photosensitive member and the cleaning device which results in a poor cleaning.

This disadvantages the cleaning device in not only removing toner from the photosensitive member, but also in removing toner from an intermediate transfer member and a sheet transfer member. The present invention overcomes the above-noted disadvantages of the background art.

Accordingly, an object of the present invention is to provide a cleaning device installed in an image forming apparatus, and including a cleaning brush configured to remove toner when applied a voltage, wherein the cleaning brush is made of a fiber, an inside part of the fiber is formed from a conductive material, and a surface part of the fiber is formed from an insulative material.

Another object of the present invention is to provide a process cartridge configured to detachably attach to an image forming apparatus which includes a photosensitive member configured to form an image with a toner on a surface thereof; and a cleaning device including a cleaning brush configured to remove a toner on the photosensitive member when applied a voltage, wherein the cleaning brush is made of a fiber, an inside part of the fiber is formed from a conductive material, and a surface part of the fiber is formed from an insulative material.

A further object of the present invention is to provide an image forming apparatus including a photosensitive member configured to form an image with a toner on a surface thereof, and a cleaning device including a cleaning brush configured to remove toner on the photosensitive member when applied a voltage, wherein the cleaning brush is made of a fiber, an inside part of the fiber is formed from a conductive material, and a surface part of the fiber is formed from an insulative material.

These and other objects, features, and advantages of the present invention will become more apparent upon consideration of the following description of the preferred embodiments of the present invention taken in conjunction with the accompanying drawings.

BRIEF DESCRIPTION OF THE DRAWING

The accompanying drawings, which are incorporated in and constitute a part of the specification, illustrate the invention, and, together with the description, serve to explain the principles of the invention.

DESCRIPTION OF THE PREFERRED EMBODIMENTS

Figure 1:
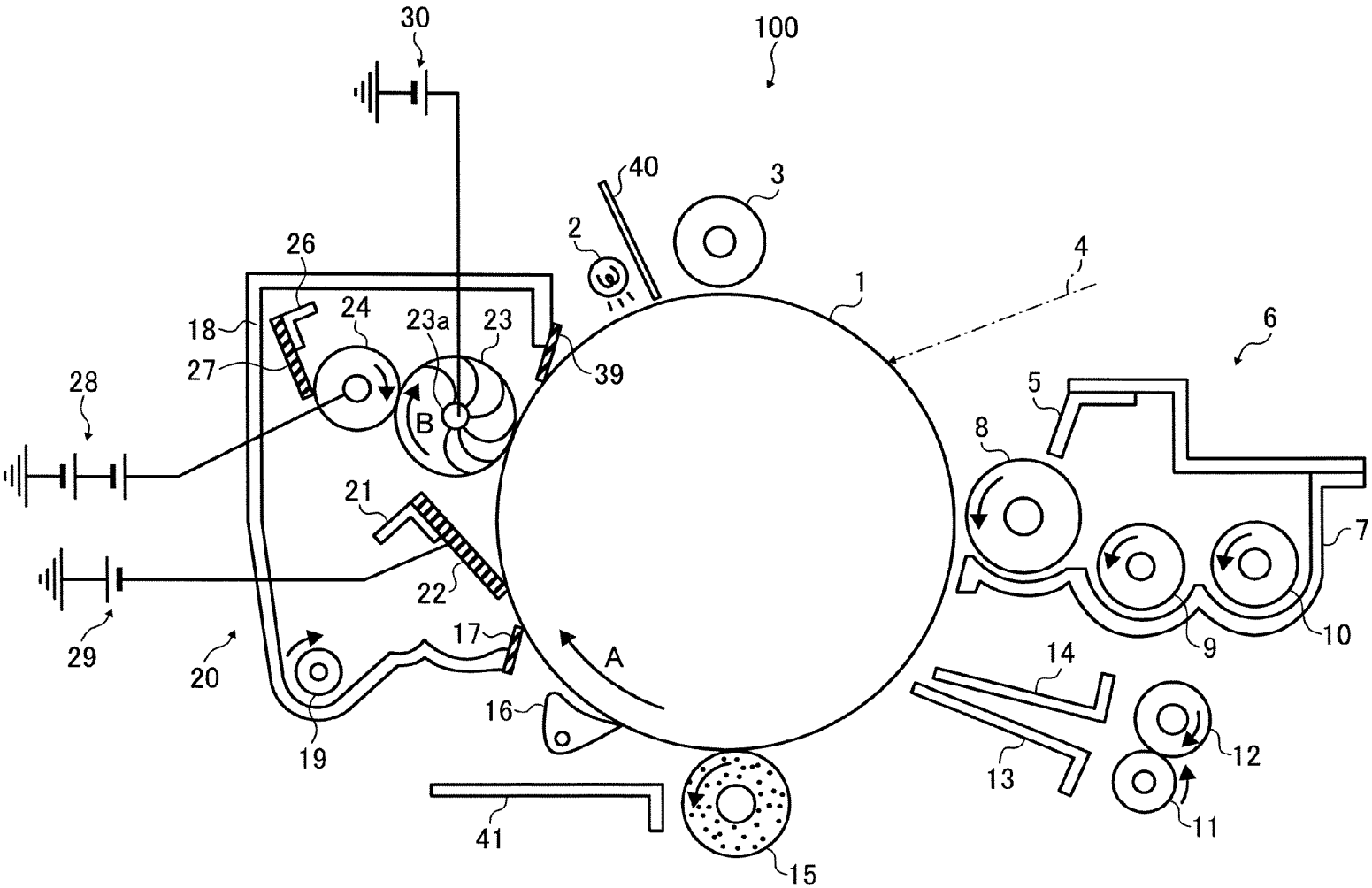
FIG. 1 is a schematic of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

FIG. 1 illustrates a structure of an image forming apparatus 100 according to an exemplary embodiment of the present invention. The image forming apparatus 100 includes a drum-shaped photosensitive member 1, serving as an image carrier. A charging roller 3, serving as a charging unit; and a developing device 6, serving as a developing unit which develops a toner image based on an electrostatic latent image, are arranged around the photosensitive member. The image forming apparatus 100 also includes a transfer roller 15, serving as a transfer unit, which transfers a toner image formed by the developing device 6 to a sheet (i.e., a recording media), a cleaning device 20, serving as a cleaning unit, which removes residual toner remaining on the surface of the photosensitive member 1, and a discharging lamp 2 which discharges the surface of the photosensitive member 1. A light shielding member 40 is arranged between the discharging lamp 2 and the charging roller 3.

The charging roller 3 opposes the photosensitive member 1 with a predetermined gap provided between the charging roller 3 and the photosensitive member 1, and charges a surface of the photosensitive member 1 with a predetermined electrical potential having a predetermined polarity. In this embodiment, the photosensitive member 1 is uniformly charged with a negative polarity.

An optical writing device (not shown) emits a laser beam 4 corresponding to image data onto a surface of the photosensitive member 1 that is uniformly charged by the charging roller 3. Thus, an electrostatic latent image is formed on the surface of the photosensitive member 1.

A developing device 6 including a developing roller 8, serving as a developing carrier, and the developing roller 8 contain a magnet. The developing device 6 includes a supplying screw 9 and an agitating screw 10 which stir two-component developer including toners and carriers in the case 7 while transporting the developer toward the developing roller 8. In addition, the developing device 6 includes a developer regulating member 5 which regulates an amount of the developer carried by the developing roller 8.

In this embodiment, pulverized toners are used. The toners are charged with a negative polarity by the supplying screw 9 and the agitating screw 10.

The developer (i.e., the charged toner) deposits on the surface of the developing roller 8 via the magnetic force generated by the magnet of the developing roller 8. At the developing position between the developing roller 8 and the photosensitive member 1, the developer forms a magnetic brush (i.e., erect toner) on the surface of the developing roller 8. A transferring roller 15 is configured to apply a transferring bias, using a power source (not shown), to the photosensitive member.

The following describes an image forming process in the image forming apparatus 100. Upon actuation of a START key (not shown), the image scanning portion (not shown) starts to read a document. The charging roller 3, the developing roller 8, the transferring roller 15, and the cleaning blade 22 are applied a predetermined voltage or electric current according to a predetermined timing. At the same time, the photosensitive member 1 is driven in the direction counter to the rotating direction A illustrated in FIG. 1 by a motor (not shown). Further, the developing roller 8, the transferring roller 15, the supplying screw 9, the agitating screw 10, the conveying auger 19, the cleaning brush 23, and the collecting roller 24 are driven in predetermined rotating directions illustrated in FIG. 1.

When the photosensitive member rotates in the direction counter to the rotating direction A illustrated in FIG. 1, the charging roller 3 charges the surface of the photosensitive member 3 to the predetermined voltage, e.g., −900 V. An optical writer (not shown) emits light 4 on the charged surface of the photosensitive member 1. The electric potential of the emitted surface of the photosensitive member 1 is reduced by, for example, −150 V, and an electrostatic latent image is formed on the photoconductor according to image data of the document.

The magnetic brush formed on the surface of the developing roller 8 contacts the surface of the photosensitive member where the latent electric image is formed (i.e., the developing portion). The developing roller 8 is applied a developing bias (e.g., −600V) and the developing roller 8 charges the toners with a negative polarity. At this time, the toners charged with the negative polarity on the surface of the developing roller 8 are transferred to the surface of the photosensitive member, and the electric latent image on the surface of the photosensitive member is developed by the toners.

The embodiment just described has an image forming section which includes a non-contact type charging roller and uses a discharged area development technique; however, the present invention is not limited to such an image forming section.

A sheet is transferred from a sheet supplying portion (not shown) to a transferring area formed between the photosensitive member 1 and a transferring roller 15 through a nip provided between an upper registration roller 11 and a lower registration roller 12 assisted by guide member 13 and 14. At this time, the sheet is transferred to the transferring area and synchronized with the toners on the surface of the image forming apparatus. The toners on the surface of the photosensitive member 1 are transferred to the sheet at the transferring area, and the transferring roller 15 is applied with the transfer bias having a predetermined current (e.g., +10 μA).

The sheet, the toners are transferred to, is separated from the surface of the photosensitive member 1 by a separating member, serving as a separating unit, and the sheet is transferred to a fixing device, serving as a fixing unit via the guide member 41. The toners are fixed to the sheet by heat and pressure while passing through the fixing device, and the sheet is discharged from the image forming apparatus.

The residual toner on the surface of the photosensitive member 1 after the transfer process is removed by the cleaning device 20, and the surface of the photosensitive member is discharged by a discharging lamp 2.

The following describes the cleaning device 20 which remove the residual toner remaining on the surface of the photosensitive member 1. As illustrated in FIG. 1, the cleaning device 20 includes the cleaning brush 23 where a positive voltage is applied by the brush power source 30. The cleaning blade 22 is arranged upstream from a portion formed between the cleaning brush 23 and the photosensitive member 1. The cleaning blade 22 is applied a negative voltage (e.g., from −800 to −1300 V) by a blade power source 29. The cleaning brush 23 rotates around a rotation axis 23*a*, and the brush power source 30 applies a positive voltage (e.g. from 200 to 300 V) to the rotation axis 23*a*.

Figure 2:
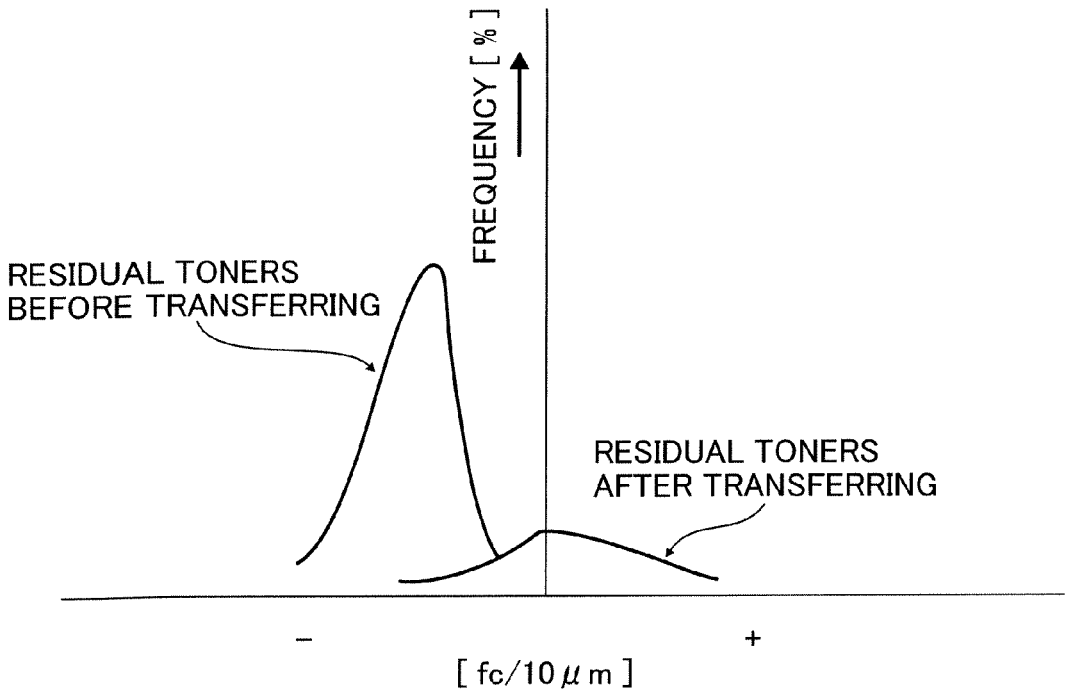
FIG. 2 is a graph illustrating distribution amounts of residual toners before transfer and residual toners after transfer to the photosensitive member at room temperature and room humidity.

The following describes the amount of charged residual toners remaining on the surface of the photosensitive member 1 arriving at the contact point of the photosensitive member 1 and the cleaning device 20. As shown in FIG. 2, almost all of the residual toners prior to the transfer process are charged with a negative polarity.

During the transfer process, residual toners charged with a positive polarity prior to the transfer process remain on the surface of the photosensitive member after the transfer process. In addition, the residual toners charged with a negative polarity prior to the transfer process are charged by electric charge injection of the transferring roller 15 which is applied with a negative polarity bias, and the polarity of the residual toner may be changed to a positive polarity. Thus, as shown in FIG. 2, both residual toners of the positive polarity and residual toners of the negative polarity coexist after the transfer process.

Figure 3:
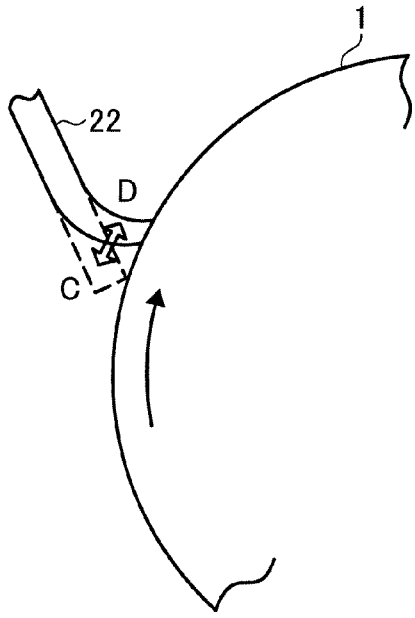
FIG. 3 is an explanatory view illustrating a cleaning brush slipping on a photosensitive member.

The residual toners on the surface of the photosensitive member after the transfer process are moved to the nip between the photosensitive member 1 and the cleaning blade 22 by the rotation of the photosensitive member. Almost all of the residual toners on the surface of the photosensitive member 1 are removed mechanically by the cleaning blade 22. However, as illustrated in FIG. 3, the cleaning blade 22 can flex (i.e., stick slipping) at the time of cleaning the surface of the photosensitive member 1. Consequently, some of the residual toners pass through the nip between the photosensitive member 1 and the cleaning blade 22.

The cleaning blade 22 is applied a voltage having a negative polarity which is the same polarity as the residual toner. When the residual toners pass through the nip between the photosensitive member 1 and the cleaning blade 22, the residual toners are injected with the charge. That is, the cleaning blade 22 charges the residual toner on the surface of the photosensitive member to a regular charged polarity (i.e., negative polarity). The toners charged with the regular negative polarity by the cleaning blade 22 are transported by rotating the photosensitive member to a cleaning area where the cleaning brush 23 removes the residual toner on the surface of the photosensitive member 1.

As illustrated in FIG. 1, the cleaning brush 23 is applied a voltage with a polarity which is opposite to the polarity of the residual toners, and the residual toners after cleaning electrostatically stick to the cleaning brush 23. The toners cleaned by the cleaning brush 23 are transferred to the collection roller 24 which is applied a voltage by the collecting power source 28 which is higher than the voltage of the brush power source (e.g., from 600V to 700V). The toners on the collecting roller 24 are removed by the collecting roller cleaning blade 27, and the toners are removed from the cleaning device 23 or are returned to the developing device 6 by the toner conveying screw 19.

The following describes the toners whose polarity is changed when the toners pass between the photosensitive member 1 and the cleaning blade 22 and applied the voltage whose polarity is same as the polarity of the toners (negative polarity). The cleaning blade 22 has an electrical resistance from about 106 to 108 [Ω·cm], and the cleaning blade 22 contacts the photosensitive member 1 by applying a pressure from about 20 gf/cm to about 40 gf/cm in a direction counter to the rotating direction of the photosensitive member. If the cleaning blade 22 is not applied a voltage, the toners passing the nip between the photosensitive member 1 and the cleaning blade 22 are charged by friction a charge generated by the pressure generated at the nip. Consequently, the distribution amounts of residual toners reflect an increase in frequency of the regular polarity (negative polarity) of the toner.

Figure 4:
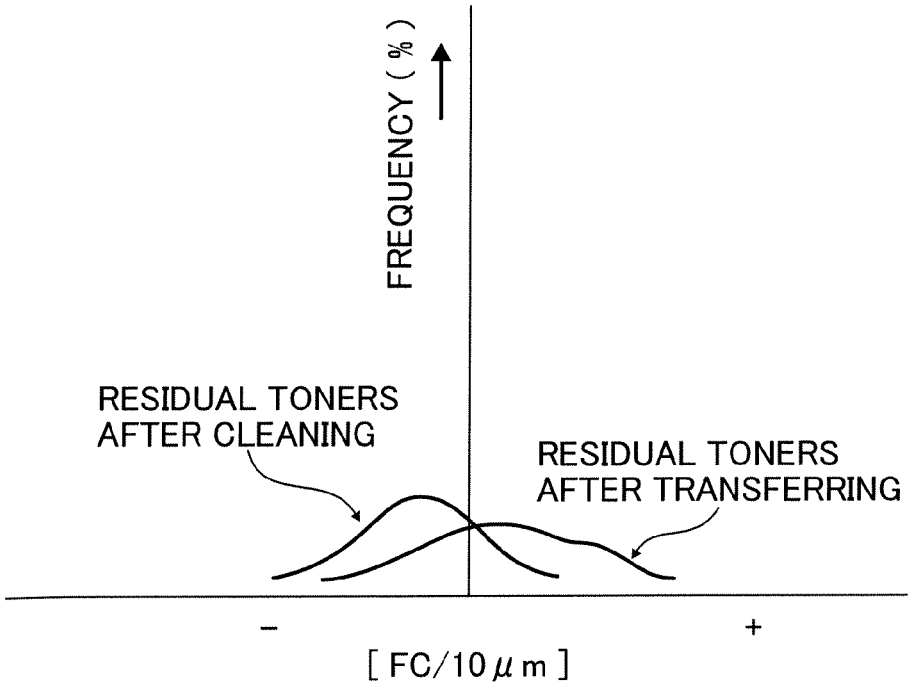
FIG. 4 is a graph illustrating distribution amounts of residual toners after transfer to the photosensitive member and residual toners after cleaning the photosensitive member.

As shown in FIG. 4, an increase in the amount of toners charged with negative polarity occurs when the toner passes the nip between the photosensitive member 1 and the cleaning blade 22. The distribution amounts of residual toners reflects an increase in the amount of regular polarity (negative polarity) toners. However, positive polarity and negative polarity toners coexist. That is, the distribution amounts of the residual toners after the transferring process is broad as shown in FIG. 4 (i.e., all of the residual toners are not charged with the regular polarity (negative polarity). Therefore, a charging device is useful in addition to a friction electrostatic charging device to ensure that the charged polarity of all residual toner after the transferring process have a regular polarity.

Moreover, the so-called stick slipping of the cleaning blade 22 changes to the same direction as the rotation photosensitive member 1 as shown in FIG. 3. When the cleaning blade 22 enters the state C of FIG. 3, the passing of the toners results.

As shown in FIG. 1, when the negative voltage is applied to the cleaning blade 22 and the residual toner reaches a position between the photosensitive member 1 and the cleaning blade 22, current flows into the residual toner at the voltage applied to the cleaning blade 22. Further, the residual toner is charged with the negative polarity of the applied voltage as the residual toner passes the nip between the photosensitive member 1 and the cleaning blade 22. Moreover, an electrical discharge is generated in a minute gap part of a wedge formed between the photosensitive member 1 and the cleaning blade 22, and the toner is charged by the electrical discharge. The residual toner having a negative polarity as a consequence of passing the cleaning blade 22 is removed electrostatically by the cleaning brush 23 which has a polarity (positive polarity) opposite to the charged polarity of the residual toner.

The following describes changes to the distribution amounts of residual toners after the development and transfer processes as a consequence of environment changes. The distribution amounts of toner were measured by an E spurt analyzer made by Hosokawa Micron.

Figure 5:
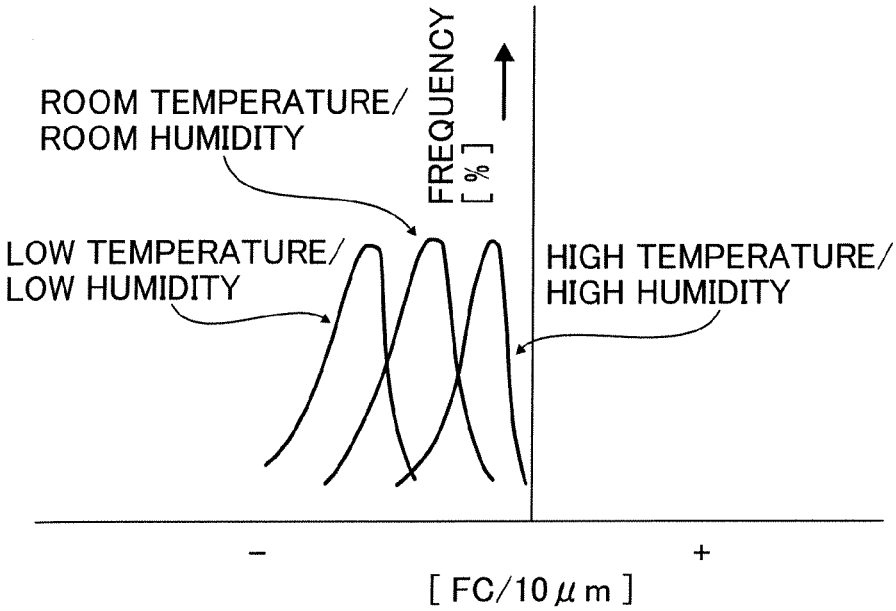
FIG. 5 is a graph illustrating distribution amounts of residual toners before transfer to the photosensitive member in a plurality of environments.

FIG. 5 expresses a ratio of the frequency that the toners were collected versus the residual toners in a vertical axis, and expresses a quantity of electrostatic charge (negative and positive polarity) of a toner in a horizontal axis. This measurement used 500 toners. FIG. 5 graphs three distribution amounts of residual toners: before the transfer process in high temperature/high humidity (i.e., 30[%], 90[%]), room temperature/room humidity (i.e., 20[%], 50[%]), and low temperature/low humidity (i.e., 10[%], 15[%] environments).

Since toner is charged by friction electrification, if humidity becomes high, it becomes difficult to charge the toner, and the amount of electrification is reduced. Therefore, the distribution amounts of toner in high temperature/high humidity approaches 0 compared with the distribution amounts of toners in room temperature/room humidity as shown in FIG. 5. Moreover, if humidity is low and the temperature is low, the distribution amounts of toners (shifts left to right) away from 0.

Figure 6:
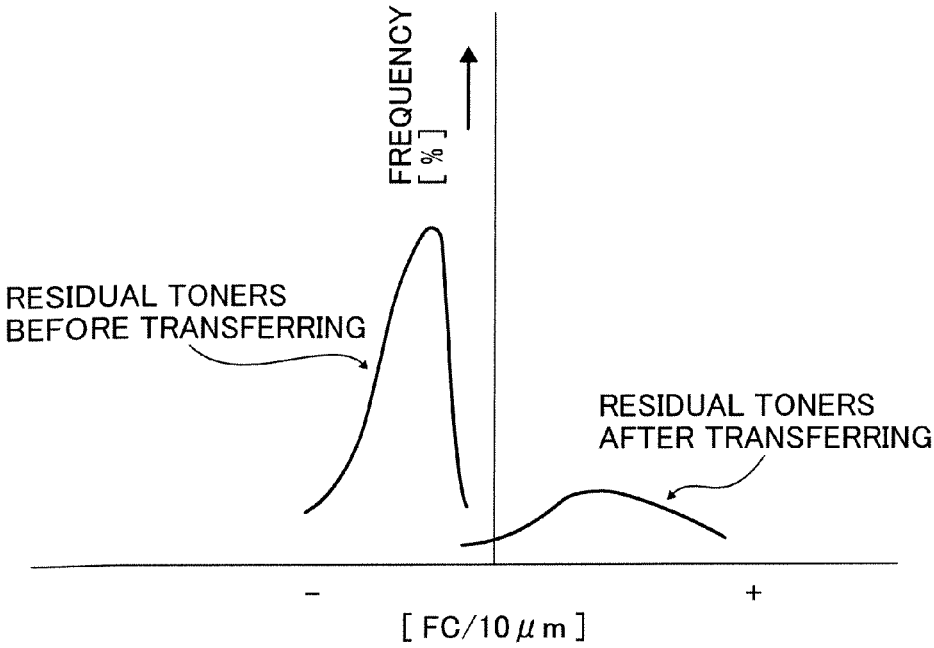
FIG. 6 is a graph illustrating distribution amounts of residual toners before transfer and residual toners after transfer to the photosensitive member in high temperature and high humidity.
Figure 7:
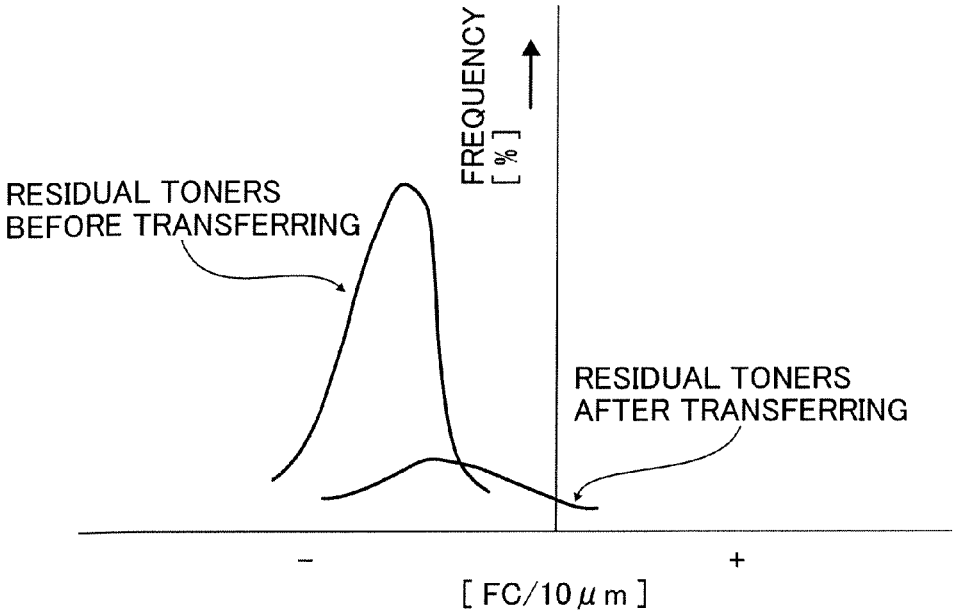
FIG. 7 is a graph illustrating distribution amounts of residual toners before transfer and residual toners after transfer to the photosensitive member in low temperature and low humidity.

The distribution amounts of residual toners after the transfer process in high temperature/high humidity environment shown in FIG. 6 shifts to the side of the positive polarity compared to the distribution amounts of residual toners after the transfer process in the room temperature/room humidity environment shown in FIG. 2. The distribution amounts of residual toners after the transfer process in low temperature/low humidity environment shown in FIG. 7 shifts to the side of the positive polarity compared to the distribution amounts of residual toners after the transfer process in room temperature/room humidity environment shown in FIG. 2. The distribution amounts of residual toners after the transfer process also change as a function of the paper thickness.

The following describes a conventional cleaning device. In an image forming apparatus, it is often required to have high resolution so that a highly precise and high definition picture can be formed. In order to obtain these goals, it is a given to use toner that reduces the particle size. Moreover, the shape of the toner used is often a ball shape in order to improve the transfer rate. By using the conventional blade cleaning method, it is very difficult to clean toners of small particle size and having a ball shape because it is easy for the cleaning blade to slip, resulting in poor cleaning.

If the line pressure of the cleaning blade is increased to high (e.g., 100 gf/cm or more), it is possible to clean a globular toner. However, the life time of the photosensitive member and the cleaning blade will be dramatically shortened. For example, in the case where the regular line pressure of the cleaning blade is applied (e.g., 20 gf/cm), the lifetime of the photosensitive member having a diameter of 30 mm (when a photosensitive layer is reduced by ⅓) is about 100,000 sheets, and the lifetime of the cleaning blade (when the cleaning blade is shaved and a poor cleaning occurs) is about 120,000 sheets. On the other hand, in the case where an extremely high line pressure of the cleaning blade is applied (e.g., 100 gf/cm), the lifetime of the photosensitive member is about 20,000 sheets, and the lifetime of the cleaning blade is about 200,000 sheets.

An electrostatic brush cleaning method has a good ability to clean toners of small particle size and toners having a ball shape, and reduces the mechanical contact with the photosensitive member thus reducing the surface film wear of the photosensitive member. The following describes the conventional electrostatic brush cleaning device referring to FIG. 8 and FIG. 9. The fiber 31 of the brush shown in FIG. 9 is formed from conductive material 32 and insulative material 33.

Figure 8:
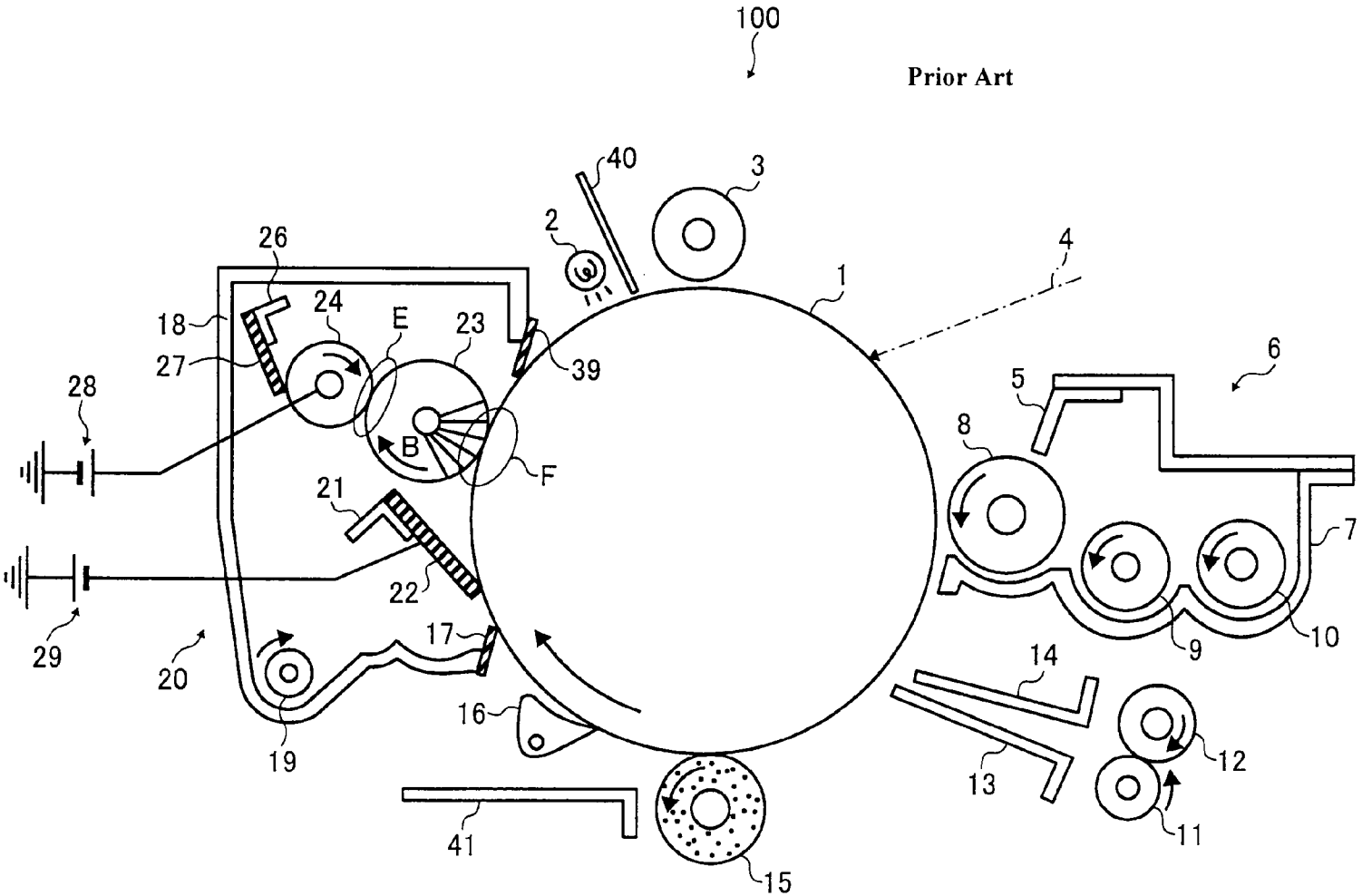
FIG. 8 Prior Art
FIG. 8 is a schematic of an image forming apparatus including a conventional electrostatic cleaning brush device.
Figure 9A:
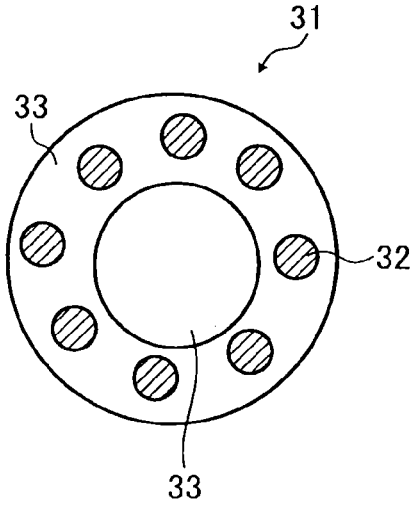
FIG. 9A and FIG. 9B are cross sections of a conventional fiber of brush.
Figure 9B:
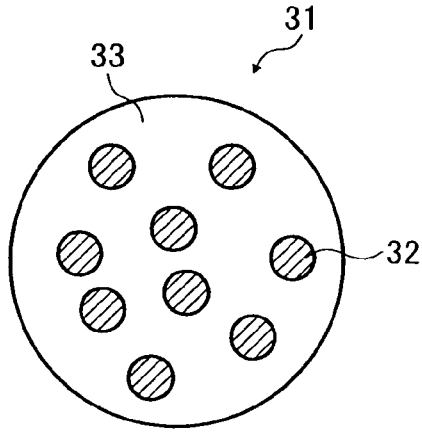
Prior Art FIG. 9B

The conventional cleaning device 20 shown in FIG. 8 includes the conductive cleaning blade 22 having an applied voltage and the cleaning brush 23 functioning as an electrostatic cleaning member located downstream of the cleaning blade 22 in the rotation of the photosensitive member 1. In this cleaning device 20, the conductive cleaning blade 22 makes the charged polarity of the residual toner even with the one side (+) side or (−) side, and the cleaning brush 23 removes the residual toners on the surface of the photosensitive member 1. However, since the brush fiber of the cleaning brush 23 is formed from a conductive material, a charge injection to the toners is generated between the photosensitive member 1 and the cleaning brush 23, and between the cleaning brush 23 and the collection roller 24. Thus, many toners injected with the charge remain on the surface of the photosensitive member 1 after the cleaning. Therefore, it is necessary to reduce the charge injection as much as possible to reduce the residual toners after the cleaning.

The following describes the charge injection phenomena. It is thought that the charge injection occurs because an electric current flows into a toner through conductive materials in the brush fiber 31. Thus, in the case of the cleaning brush 23 having a conductive material 32 dispersed in the surface of the brush fiber 31, the probability that the conductive material 32 and a toner come in contact with each other is high. The charge injection to the toner is thus generated, and the toner is charged with the polarity of the voltage applied to the cleaning brush 23. Moreover, when the polarity of the toner is controlled by the cleaning blade 22, the distribution amounts of the residual toners after the transfer process is influenced.

When the distribution amounts of the residual transferring toner has been severely biased to the positive side, the residual toner has a low electrification level even if the polarity is controlled with the conductive cleaning blade 22. Further, the polarity of the toner reverses easily in area E or area F shown in FIG. 8 when the toner moves to the cleaning brush 23 or moves to the collecting roller 24. The toner reversing polarity transfers to the photosensitive member 1 again and will remain as uncleaned residual toner.

Figure 10:
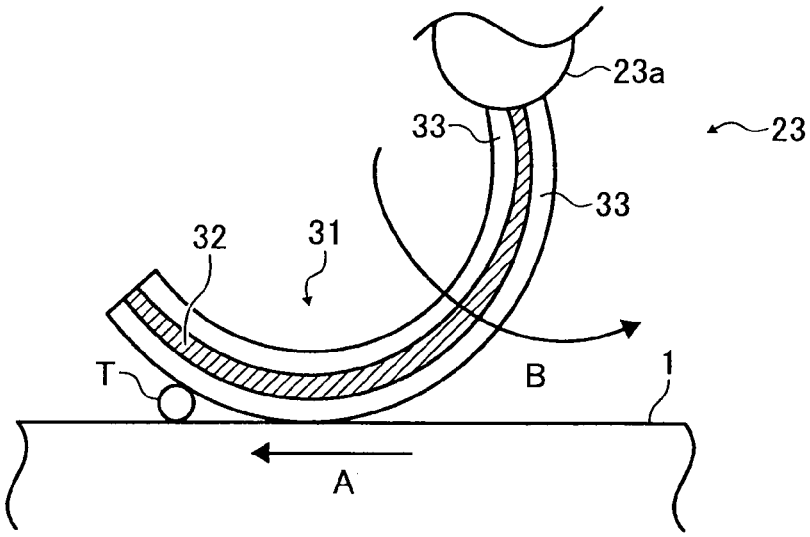
Prior Art FIG. 10
FIG. 10 is a cross section of a fiber of a cleaning brush of the present invention.
Figure 11A:
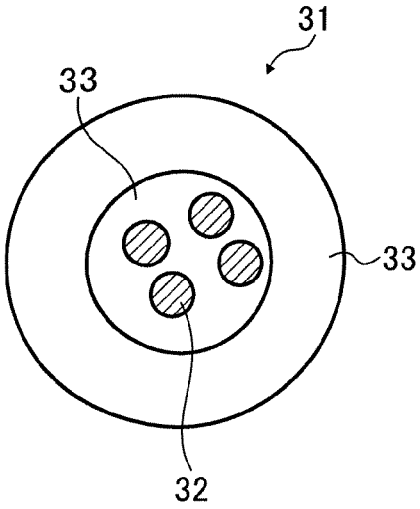
FIG. 11A and FIG. 11B are cross sections of a fiber of a cleaning brush of the present invention.
Figure 11B:
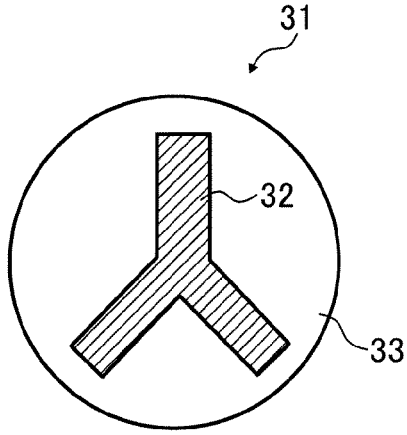

The following describes an embodiment for solving this problem. FIG. 10 is a cross section of the fiber 31 of the cleaning brush 23 of the cleaning device 20 of the present invention. FIG. 11A and FIG. 11B are also cross sections of the fiber 31 of the cleaning brush 23 of the present invention. As shown in FIG. 10 and FIG. 11, the fiber 31 of the cleaning brush 23 has a core-in-sheath structure having two layers where an inside part is formed from a conductive material 32 and a surface part is formed from an insulating material 33. The electric resistance of the insulative material 33 is preferably over 109 Ωcm. This core-in-sheath structure of the fiber 31 has a surface which is formed from an insulative material 33. Thus, toner does not come in contact with the conductive material 32 other than a (surface) section of the fiber 31. As a result, the charge injection from the cleaning brush 23 to the toner to be removed is prevented. For the brush fiber 31, an insulative material such as nylon, polyester, and acrylic can be used. The brush fiber 31 can prevent the charge injection to the toner removed from the cleaning brush 23 using any of these materials. As shown in FIG. 10, the brush fiber 31 of the cleaning brush 23 in this embodiment is a curved fiber which extends to the side reverse to the rotating direction (the direction of arrow B in FIG. 10 in FIG. 10) of the cleaning brush 23.

Figure 12:
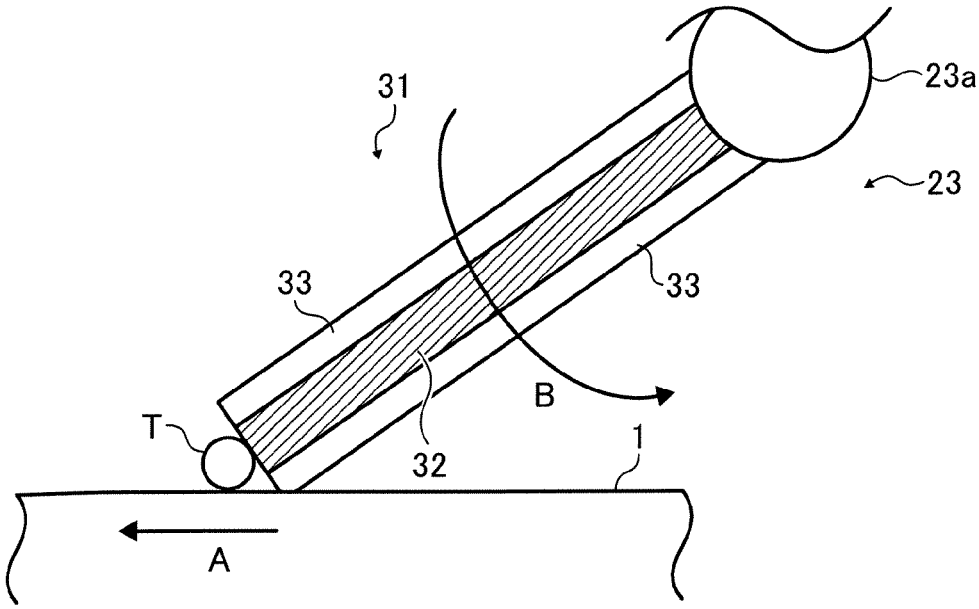
FIG. 12 is a cross section of a straight fiber of a cleaning brush.

FIG. 12 is a cross section of the brush fiber 31 of the cleaning brush which is installed radially from the brush axis 23*a*. The brush fiber is a straight fiber which has a core-in-sheath structure having two layers where an inside part is formed from the conductive material 32 and a surface part is formed from the insulating material 33. The arrow B in FIG. 12 shows the rotating direction of the cleaning brush 23, (i.e., the rotating direction of the brush fiber 31).

As shown in FIG. 12, in the case where the brush fiber 31 of the cleaning brush 23 is a straight fiber, it is possible that the conductive material 32 and a toner T come in contact at an end face of a tip portion of the brush fiber 31, and the charge injection from the cleaning brush 23 to the toner T occurs. On the other hand, in the case where the brush fiber 31 of the cleaning brush 23 is a curved fiber, it is difficult for the conductive material 32 and a toner T to come in contact with the end face of the tip section of the brush fiber 31. Thus, a charge injection from the cleaning brush 23 to the toner can be prevented when the toners transfer from the photosensitive member 1 to the cleaning brush 23 and from the cleaning brush 23 to the collecting roller 24 when no contact is made.

The following describes the area where the charge injection occurs in the case where the brush fiber 31 of the cleaning brush 23 is a straight fiber as shown in FIG. 8. The charge injection to the toners occurs in the area E and F shown in FIG. 8. The collecting roller 24 is applied with a voltage from the source 28, and electric power is supplied from the collecting roller 24 to the cleaning brush 23. Some of the residual toner on the surface of the photosensitive member 1 is transferred to the cleaning brush 23. The charge injection in the area E occurs at the moment when toner comes in contact with a conductive material of the brush fiber. Low charged toners are charged to the opposite polarity of the applied voltage, and those toners are not transferred to the cleaning brush 23 but rather pass the nip between the photosensitive member 1 and the cleaning brush 23 remaining on the surface of the photosensitive member 1. Moreover, although highly charged toners are also injected with the charge, the polarity of the highly charged toners is not changed, and the toners are transferred to the cleaning brush 23.

The toners transferred from the photosensitive member 1 to the cleaning brush 23 whose polarity is opposite to the voltage applied to the collecting roller 24 are transferred to the collecting roller 24. At this time, the low charged toners are charged to the opposite polarity of the applied voltage, and the toners are not transferred to the collecting roller 24 and remain on the cleaning brush 23. Further, the cleaning brush 23 rotates and the toners contact the surface of the photosensitive member 1, transfer to the surface of the photosensitive member 1, and remain the surface of the photosensitive member 1 as residual toners.

On the other hand, in the case that the brush fiber of the cleaning brush has a core-in-sheath structure and is a straight fiber as shown in FIG. 10, it is difficult for the conductive material 32 of the brush fiber 31 and a toner to come in contact with each other. This configuration of the cleaning brush 23 and the collecting roller 24 can prevent the charge injection to the toner in a nip between the photosensitive member 1 and the cleaning brush 23.

Figure 13:
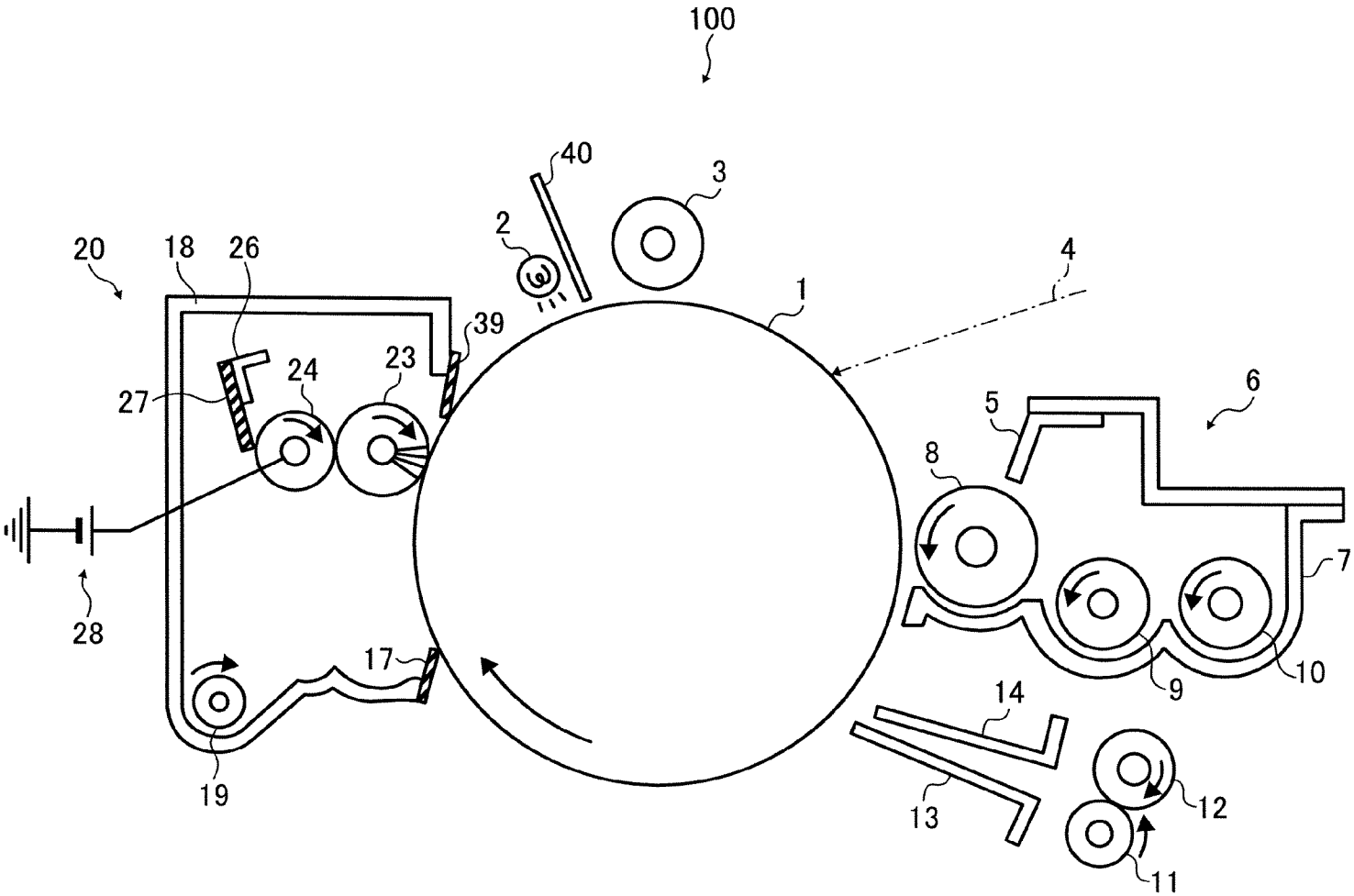
FIG. 13 is a schematic of an image forming apparatus without the transferring device and the cleaning blade illustrated in FIG. 8.

Next, it was confirmed that the charge injection occurs in the area E and F. FIG. 13 illustrates an image forming apparatus without the transferring device and the cleaning blade 22 illustrated in FIG. 8. Almost all of the residual toners before cleaning by the cleaning brush 23 have a negative polarity because the residual toners remain on the surface of the photosensitive member after the developing.

In order to confirm the charge injection, the photosensitive member 1 was stopped when the tip of the toner image had rotated twice past the cleaning brush 23 after passing the nip between the photosensitive member 1 and the cleaning brush 23. Further, the distribution of q/d of the toner on the surface of the photosensitive member 1 facing the cleaning brush 23 after two rotations was measured. When the cleaning brush 23 rotates one rotation after beginning the cleaning of the toner image on the surface of the photosensitive member 1, the cleaning brush 23 has contacted the collecting roller 24, and charge injection has occurred between the cleaning brush 23 and the collecting roller 24. Thus, the distribution of q/d of the toners on the surface of the photosensitive member 1 after two rotations reflects whether the charge injection occur.

Figure 14:
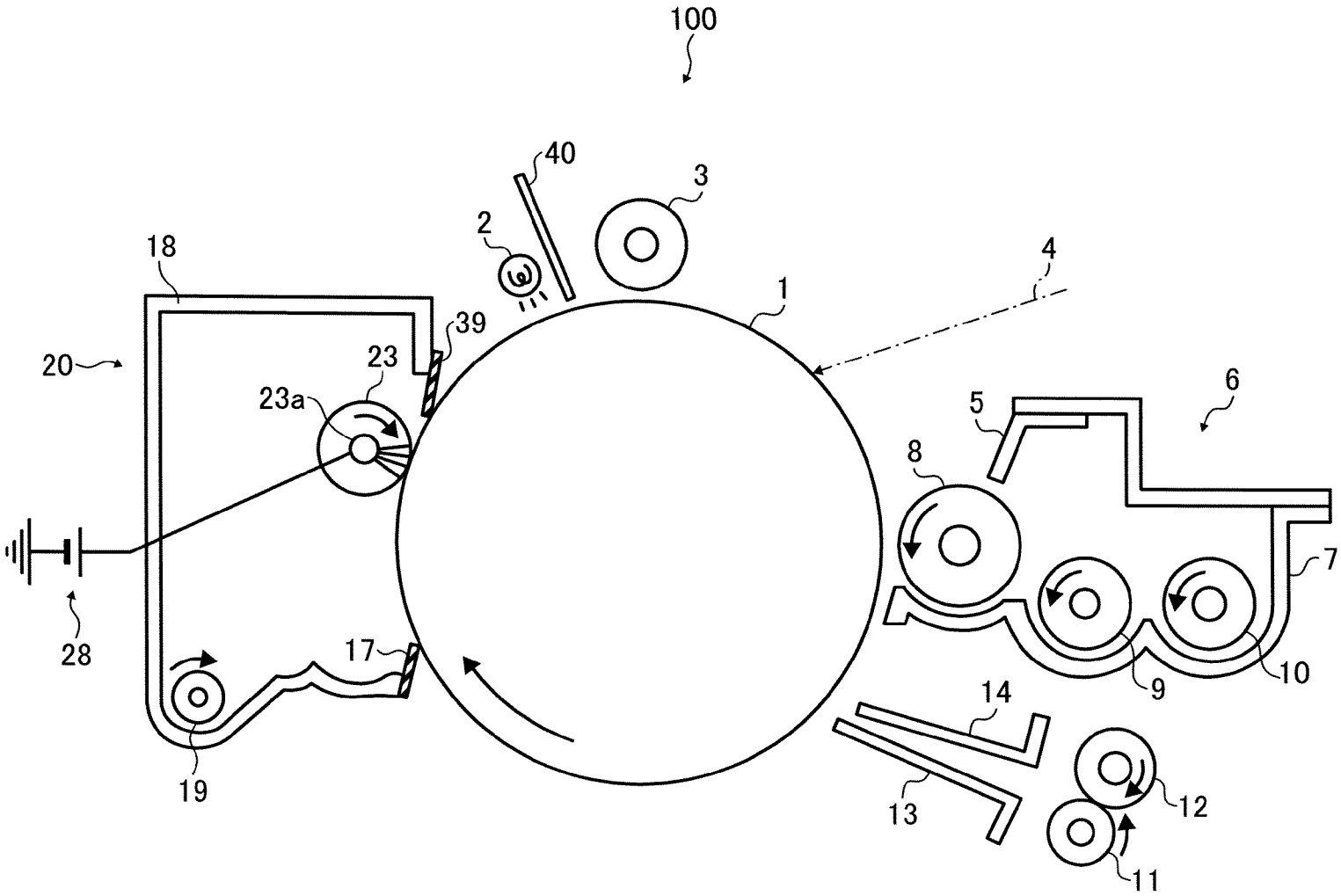
FIG. 14 is a schematic of an image forming apparatus without the collecting roller and collecting roller cleaning blade illustrated in FIG. 13 wherein the cleaning brush is applied a voltage.

FIG. 14 is a schematic of an image forming apparatus without the collecting roller 24 and the collecting roller cleaning blade 27 (illustrated in FIG. 13), wherein a voltage is applied directly to the brush axis 23*a* of the cleaning brush 23 (contrast with the image forming apparatus illustrated in FIG. 13).

Using this configuration, it can be determined whether charge injection occurs between the cleaning brush 23 and the collecting brush 24. In order to make that determination, the photosensitive member 1 was stopped when the tip of the toner image had rotated twice past the cleaning brush 23 after passing the nip between the photosensitive member 1 and the cleaning brush 23. In addition, the brush fiber of the cleaning brush 23 shown in FIG. 14 is a straight fiber.

Figure 15:
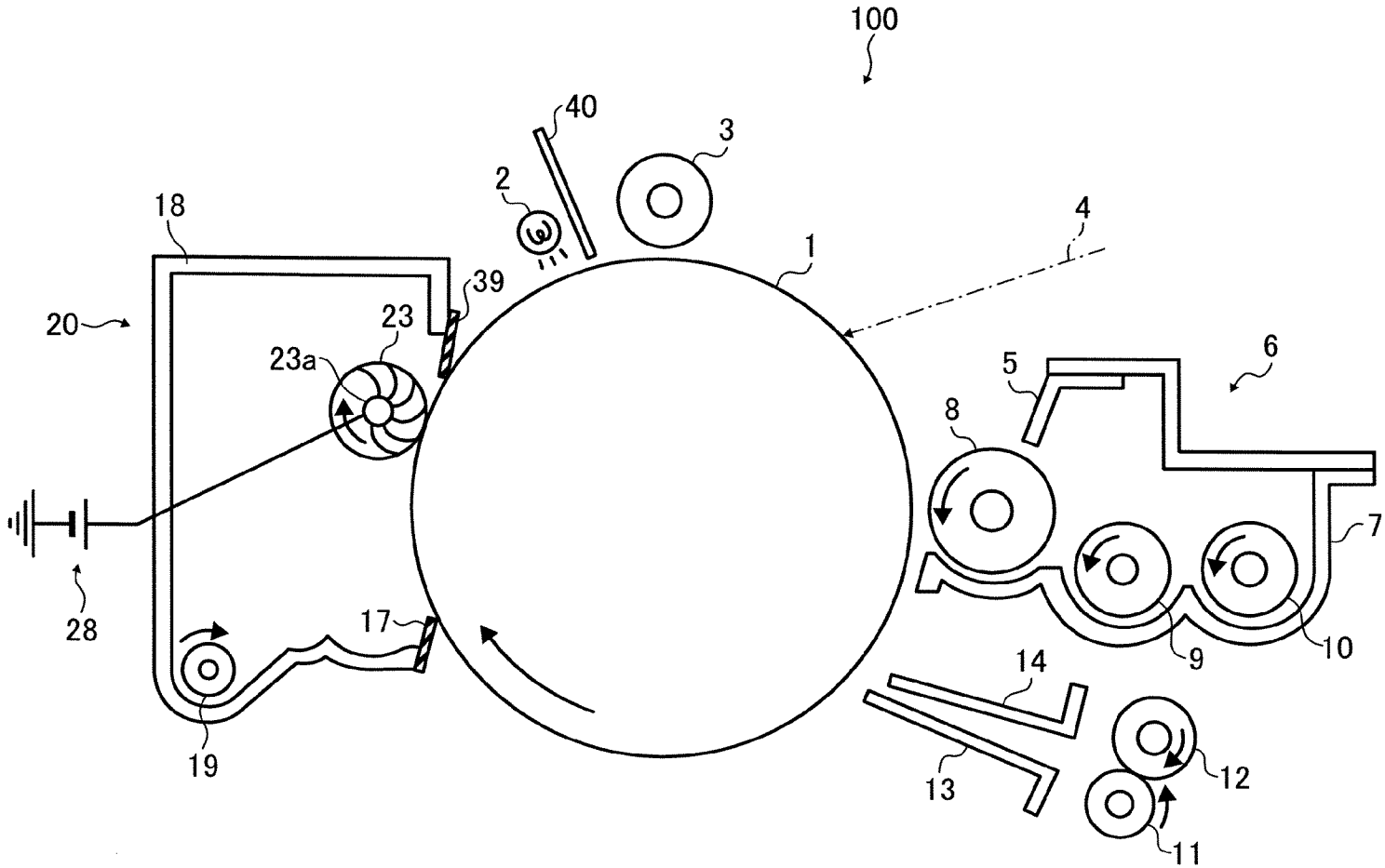
FIG. 15 is a schematic of an image forming apparatus including the cleaning brush illustrated in FIG. 14 having curved fibers.

FIG. 15 is a schematic of an image forming apparatus, wherein the fiber of the cleaning brush 23 illustrated in FIG. 14 is curved in lieu of being straight.

Figure 16:
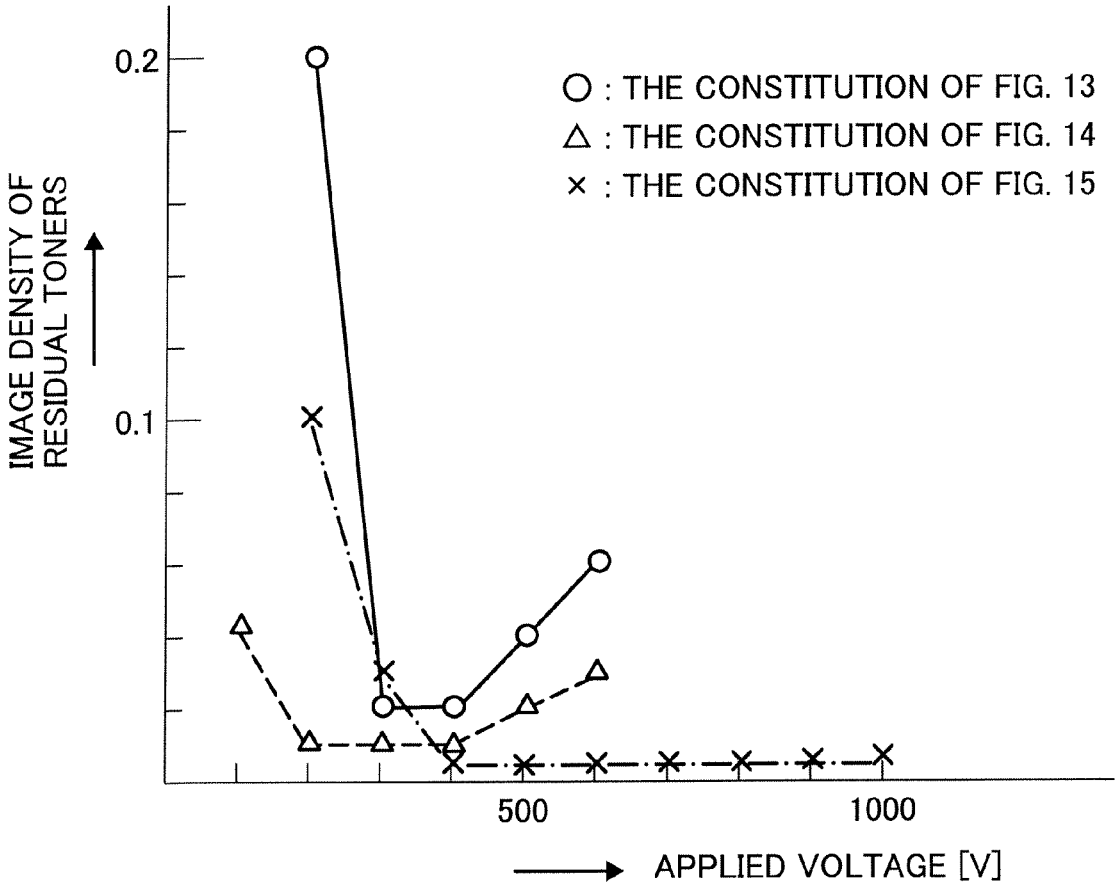
FIG. 16 is a graph illustrating the cleaning abilities of the configurations of FIG. 13, FIG. 14 and FIG. 15.

FIG. 16 is a graph illustrating the cleaning ability of the various configurations shown in FIG. 13, FIG. 14 and FIG. 15. The vertical axis reflects an image density of the residual toners after cleaning, and the horizontal axis reflects an applied voltage to the collecting roller 24 or the cleaning brush 23.

The following describes how the image density of the residual toners after cleaning was measured. At first, the toners on the surface of the photosensitive member 1, after cleaning by the cleaning brush 23, were transferred by Scotch tape. Next, the tape with the residual toner was provided on paper and analyzed by a spectrum colorimetric meter (X light made by AMUTEKKU). Additionally, the tape itself without residual toner was provided on paper and analyzed by the spectrum colorimetric meter.

Then, the difference between the measurement of the tape with residual toners and the measurement of the tape itself reflects an image density of residual toners (referred to as "ID" hereinafter). ID and the number of the residual toners on the surface of the photosensitive member have a correlation—the values of ID increase if the number of toner increases. Therefore, ID can judge the cleaning characteristics. As shown in FIG. 16, the ID of the constitution of FIG. 14 is lower than the ID of the constitution of FIG. 13, and the ID of the constitution of FIG. 15 is lower than the ID of the constitution of FIG. 14 in the case where the applied voltage is over 500 V.

Almost all of the residual toners in the case where the applied voltage is high are charged, and have the same polarity as the polarity of the applied voltage. In contrast thereto, almost all of the residual toners in the case where the applied voltage is low can not be removed. In the case where the charged voltage is over 500 V, the ID reflects the toners which have a positive polarity. On the other hand, in the where that the charged voltage is under 200 V (under 100V in the constitution of FIG. 14), ID reflects the toners which have a negative polarity.

As reflected by FIG. 16, the charge injection occurs in the nip between the photosensitive member 1 and the cleaning brush 23, and between the cleaning brush 23 and the collecting roller 24. Moreover, the ID of the constitution of FIG. 15 reflects that the charge injection rarely occurs in the case where the brush fiber of the cleaning brush 23 has a curved fiber.

The following describes a non-limiting constitution of the cleaning brush and the collecting roller.

the material of the cleaning brush: conductive polyester
the width of the cleaning brush: 5 mm
the length of the brush fiber: 5 mm
the amount of the intrusion to the photosensitive member of the cleaning brush: 1 mm
the electric resistance of the brush fiber: 108 [Ωcm]
the density of the brush fiber: 100,000/inch$^2$
the material of the collecting roller: SUS
the diameter of the collecting roller: 10 mm The following describes a non-limiting constitution of the collecting roller cleaning blade 27.

the contact angle to the collecting roller: 20°
the amount of the intrusion to the collecting roller of the collecting roller cleaning blade: 1 mm
the material of the collecting roller cleaning blade: polyurethane rubber The amount of the bend of the brush fiber 31 is different in the diameter of the photosensitive member 1 and the collecting roller 24. One primary decision was that the photosensitive member 1 or the collecting roller 24 and the conductive material 32 of the brush fiber 31 do not come in contact.

The curved fiber of the cleaning brush 23 is made by heating the cleaning brush having a straight brush fiber with a jig while rotating the cleaning brush. The jig has the same shape as the intended shape of the cleaning brush. The length of the fiber from the brush axis 23*a* to the tip of the fiber should be longer than the case where the cleaning brush is made of a straight fiber.

Figure 28:
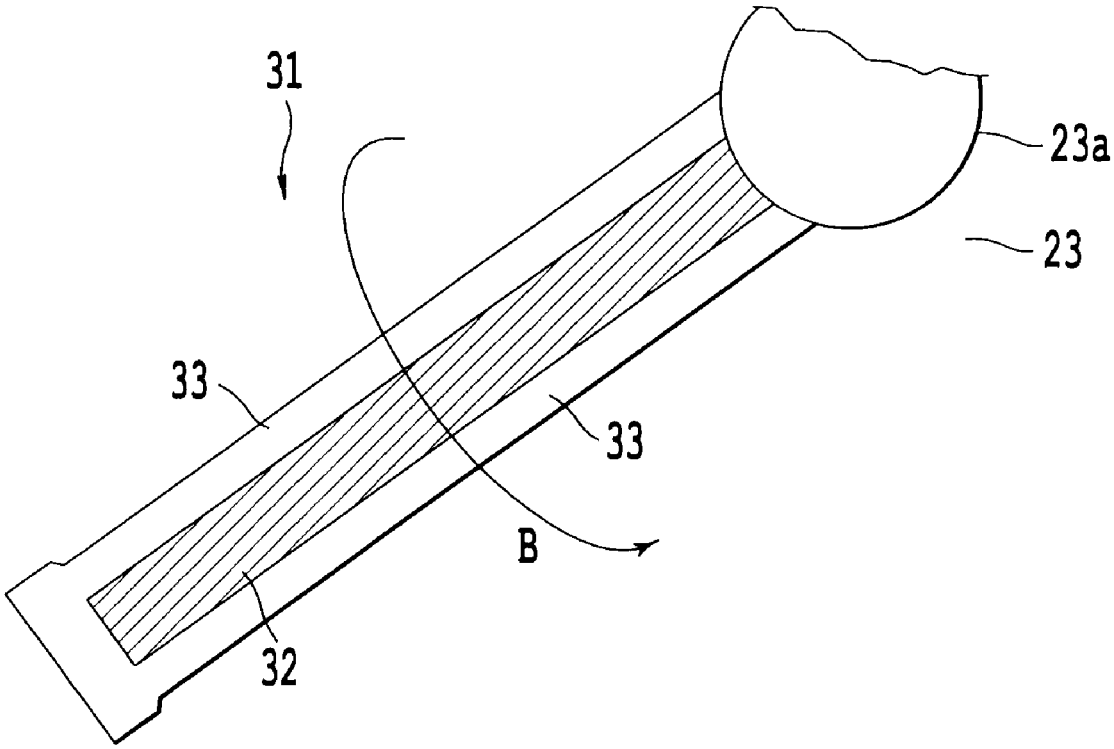
FIG. 28 is a cross section of a straight fiber of a cleaning brush having an insulative

The embodiment of the invention just described uses a cleaning brush made of curved fiber, but the present invention is not limited to such a cleaning brush. For example, according to an embodiment of the invention a cleaning brush where the end face of the tip of the fiber 33 is made of an insulative material can be used. See FIG. 28.

The following describes an embodiment of a cleaning blade 22. The cleaning blade 22 contacts the surface of the photosensitive member 1 in a direction counter to the rotating direction, illustrated in FIG. 1, of the photosensitive member 1. The cleaning blade 22 contacts the surface of the photosensitive member 1 at an angle of about 20 degrees and applies a pressure of about 20 g/cm. The cleaning blade 22 includes a blade bonded to a blade supporting member 21, and the blade has a thickness of about 2 mm, a fee length of about 7 mm, a JIS-A hardness of from about 60 to 80, and a rebound resilience of about 30%. The cleaning blade 22 does not remove all residual toner, and there is no problem that the amount of the toner processed by the cleaning device will decrease and increase to some extent.

The polarity of the voltage applied to the cleaning blade 22, the cleaning brush 23, and the collecting roller 24 may be opposite to the polarities of this embodiment. The preceding embodiment has assumed use of a crushed toner, but the present invention is not limited to crush toner, a spherical toner can be used. In the case of the spherical toner, the residual toners after the transfer process decreases relative to the case where crush toner is used. However, the toner on the surface of the collecting roller 24 is hard to remove using the collecting roller cleaning blade 27.

The following describes a process for cleaning the spherical toner on the surface of the collecting roller 24. The collecting roller 24 only has to function to make the toner, which stuck to the cleaning brush 23, transfer to the collecting roller 24 as a consequence of the electric potential between the cleaning brush 23 and the collecting roller 24. Therefore, the surface of the collecting roller 24 should only be conductive, and various material can be used as the collecting roller 24 unlike the photosensitive member 1. Further, the spherical toners on the surface of the collecting roller 24 can be removed by coating the surface of the collecting roller with a material having a low coefficient of friction, or by using a combination of, for example, a metal roller having an outer conductive tube having a low coefficient of friction, and high pressure generated between of the collecting roller 24 and the cleaning blade 27. Fluorine coating and PVDF, PFA are materials having a low coefficient of friction.

Figure 17:
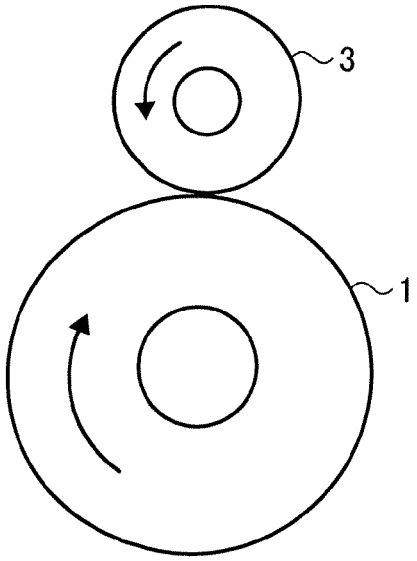
FIG. 17 illustrates a charging device including a contact type charging roller.
Figure 18:
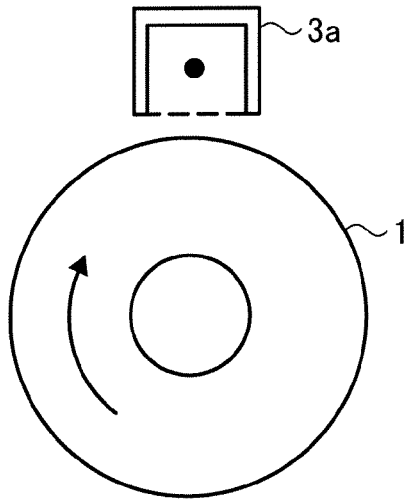
FIG. 18 illustrates a charging device including a corona charge.
Figure 19:
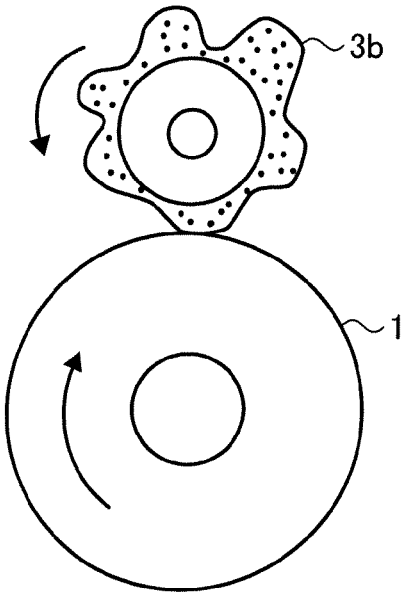
FIG. 19 illustrates a charging device including a magnetic brush.
Figure 20:
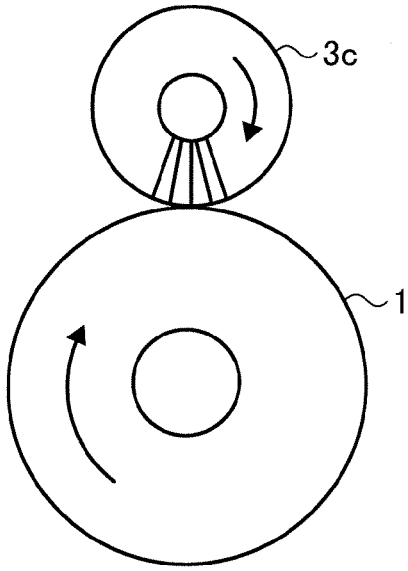
FIG. 20 illustrates a charging device including a charging roller.

Instead of the charging roller 3 opposing the photosensitive member 1 with a predetermined gap provided the charging roller 3 and the photosensitive member 1, the charging roller can contact the surface of the photosensitive member as illustrated in FIG. 17. A corona charger 3*a* illustrated in FIG. 18, a magnetic brush 3*b* illustrated in FIG. 19, and a fir brush 3*c* illustrated in FIG. 20 can be used as the charging device.

(Amorphous Silicon Photoconductor)

According to an embodiment of this invention, the photosensitive member 1 can be an amorphous silicon photosensitive member. As this photosensitive member for electro photography, a conductive base material can be heated to 50 degrees C.-400 degrees C., and the amorphous silicon photosensitive member (hereinafter referred to as "a-Si photoconductor") which has a photoconductive layer consisting of a-Si is formed on the conductive base material using methods such as the vacuum evaporation technique, the sputtering method, the ion plating method, the heat CVD method, the optical CVD method, or the plasma-CVD method. It is preferable to use the plasma-CVD method that decomposes material gas by a direct current, high frequency wave or microwave glow discharge, and forms a-Si membranes on the conductive base material.

(Layer Structure)

Figure 21A:
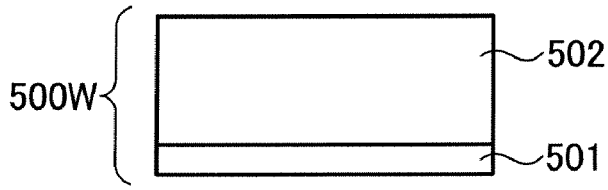
FIG. 21A, FIG. 21B, FIG. 21C and FIG. 21D are schematics of an a-Si photoconductor.

As illustrated in FIG. 21A, the a-Si photoconductor 500W includes a conductive base material 501 and a photoconductive layer 502. The photoconductive layer 502 is formed on the conductive base material 501. The photoconductive layer 502 includes a-Si:H, X and has a photoconductive property.

(Layer Structure)

Figure 21B:
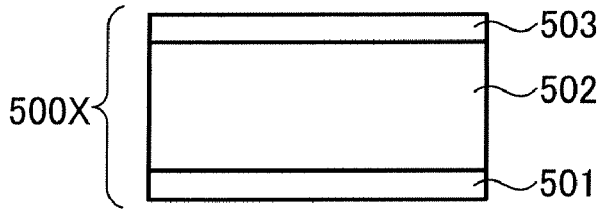

As illustrated in FIG. 21B, the a-Si photoconductor 500X includes the conductive base material 501, the photoconductive layer 502, and a surface layer 503. The surface layer 503 is formed on the photoconductive layer 502 and includes amorphous silicon.

Figure 21C:
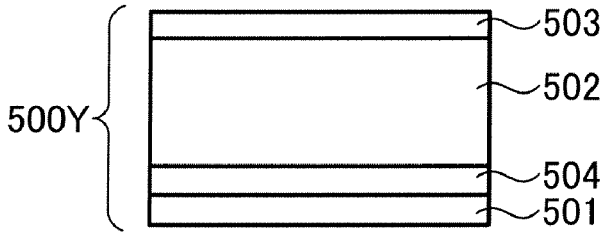

As illustrated in FIG. 21C, the a-Si photoconductor 500Y includes the conductive base material 501, the photoconductive layer 502, the surface layer 503, and a block layer 504. The block layer 504 is sandwiched between the conductive base material 501 and the photoconductive layer 502.

Figure 21D:
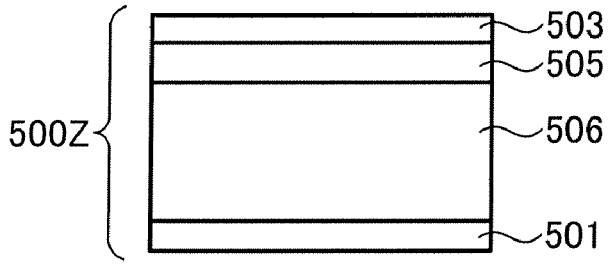

As illustrated in FIG. 21D, the a-Si photoconductor 500Z includes the conductive base material 501, the surface layer 503, a charge generating layer 505, and a charge transporting layer 506. The charge transporting layer 506 is formed on the conductive support 501, and includes amorphous silicon. The charge generating layer 505 is formed on the charge transporting layer 506. The surface layer 503 is formed on the charge generating layer 505.

As illustrated in FIGS. 21A, 21B, 21C, and 21D, the a-Si photoconductors 500W, 500X, 500Y, and 500Z include the photoconductive layer 502 and the surface layer 503 as an outermost layer, respectively. The photoconductive layer 502 and the surface layer 503 include amorphous silicon, providing improved endurance.

(Conductive Base Material)

Examples of the conductive base material 501 of the a-Si photoconductor include metals such as aluminum, chromium, molybdenum, author, indium, niobium, tellurium, vanadium, titanium, platinum, palladium, and iron, and alloys thereof such as stainless steel. An insulative base material, which carries out electric conduction processing of at least the front face of the side that forms a photosensitive layer, can be used as the conductive base material 501 of the a-Si photoconductor. A film of synthetic resin of polyester, polyethylene, a polycarbonate, cellulose acetate, a polypropylene, a polyvinyl chloride, polystyrene, and a polyamide and sheets, glasses and ceramics can be used as the insulative base material. The conductive base material can have the shape of a cylinder, a sheet or an endless belt which has a smooth front face or a concavo-convex front face. The thickness of the conductive material can be varied. When flexibility of the photosensitive member is required, the thickness of the conductive base material 501 can be made as thin as possible so long as it can still function as a base material. The conductive base material 501 is usually set to 10 micrometers or more to account for mechanical strength during manufacture and handling.

(Block Layer)

It is preferred that the block layer 504 is sandwiched between the conductive base material 501 and the photoconductive layer 502 (refer to FIG. 21C). The block layer 504 has a polarity dependency. Namely, when a charge of single polarity is applied to a free surface of the photosensitive member, the block layer 504 function so as to inhibit a current injection from the conductive base material 501 to the photoconductive layer 502, and when the charge of opposite polarity is applied, the block layer 504 does not function. In order to attain such function, the block layer 504 has relatively a lot of atoms, which control conductivity, compared with the photoconductive layer 502. The thickness of the photoconductive layer is preferably about 0.1 μm to about 5 μm, more preferably 0.3 μm to 4 μm, and furthermore preferably 0.5 μm to 3 μm.

(Photoconductive Layer)

The photoconductive layer 502 is disposed above the substrate. The thickness of the photoconductive layer 502 is not particularly limited, provided that a predetermined electrophotographic property and cost efficiency are obtained. The thickness thereof is preferably about 1 μm to about 100 μm, more preferably 20 μm to 50 μm, and furthermore preferably 23 μm to 45 μm.

(Charge Transporting Layer)

The charge transporting layer 506 is, in the case that the photoconductive layer 502 is divided by its functions, a layer which mainly functions to transport currents. The charge transporting layer 506 contains at least a silicon atom, a carbon atom, and a fluoride atom as its essential components. If needed, the charge transporting layer 506 further contains a hydrogen atom and an oxygen atom so that the current transporting layer is formed of a-SiC(H,F,O). Such a charge transporting layer exhibits desirable photoconductivity, especially a current holding property, a current generating property, and a current transporting property. It is particularly preferable that the charge transporting layer contains an oxygen atom.

The thickness of the current transporting layer is suitably adjusted so as to obtain desirable electrophotographic property and cost efficiency. The thickness thereof is preferably about 5 μm to about 50 μm, more preferably 10 μm to 40 μm, and most preferably 20 μm to 30 μm.

(Charge Generating Layer)

The charge generating layer 505 is, in the case that the photoconductive layer 502 is divided by its functions, a layer which mainly functions to generate charges. The charge generating layer 505 contains at least a silicon atom as an essential component and does not substantially contain a carbon atom. If needed, the charge generating layer 505 further contains a hydrogen atom so that the charge generating layer 505 is formed of a-Si:H. Such a charge generating layer 505 exhibits desirable photoconductivity, especially a charge generating property and a charge transporting property.

The thickness of the charge generating layer 505 is suitably adjusted so as to obtain a desirable electrophotographic property and cost efficiency. The thickness thereof is preferably about 0.5 μm to about 15 μm, more preferably 1 μm to 10 μm, and most preferably 1 μm to 5 μm.

(Surface Layer)

The amorphous silicon photoconductor used in the present invention may further contain a surface layer 503 disposed on the photoconductive layer 502 which is formed on the substrate as mentioned above. It is preferred to contain an amorphous silicon surface layer. The surface layer 503 has a free surface so that desirable properties such as moisture resistance, repeating property, electric pressure tightness, environmental capability, durability and the like can be obtained.

The thickness of the surface layer 503 is generally about 0.01 μm to about 3 μm, preferably 0.05 μm to 2 μm, and more preferably 0.1 μm to 1 μm. When the thickness thereof is less than about 0.01 μm, the surface layer 503 is worn out during usage of the photoconductor. When the thickness thereof is more than about 3 μm, an electrophotographic property is impaired such as an increase of residual charge, or the like.

The a-Si photoreceptor has a high surface hardness, a high sensitivity to light having a long wavelength of from 770 to 800 nm such as a laser diode, little deterioration due to repeated use, and therefore is advantageously used as an electrophotographic photoreceptor for high-speed copiers and laser beam printers (LBP). In addition, when the surface layer 503 includes a filler or the charge transporting layer includes a cross-linkage charge transport material improves wear resistance of the photosensitive member.

The surface layer of the photosensitive member includes a polymer or a copolymer of vinylfluoride, vinylidene fluoride, chlorotrifluoroethylene, tetrafluoroethylene, hexafluoropropylene, and perfluoroalkyl vinylether. The filler which is contained by the surface layer includes organic filler and inorganic filler, and inorganic filler is preferable. Examples of organic filler include silicone resin powder like polytetrafluoroethylene, silicone resin powder and a-carbon powder. Examples of inorganic filler include metal oxide such as silica, tin oxide, zinc oxide, titanium oxide, alumina, zirconia, indium oxide, antimony oxide, bismuth oxide, calcium oxide, tin oxide doped with antimony and indium oxide doped with tin, and metal fluoride such as tin fluoride, calcium fluoride and aluminum fluoride, titanium acid potassium, and boron nitride. These fillers can be used not only alone but also two or more mixture. And it is preferred that these fillers are performed surface treatment with surface treatment medicine in order to improve dispersibility. The average particle size of filler is preferably under 0.5 μm more preferably under 0.2 μm In addition, the surface layer includes plasticizing agent or leveling agent.

The conductive base material includes metal, such as aluminum and stainless steel, paper, and plastic. The shape of the conductive base material can be a drum or a film. It is preferred that an undercoating layer is formed on the conductive base material. The undercoating layer is formed to improve an adhesive and coating nature of the photosensitive layer, and to protect the conductive base material, to cover a defect on the conductive base material, to improve the charge injection from the conductive base material, and to protect the electric covering of the photosensitive layer. The undercoating layer can be a polyvinyl alcohol, a Polly N-vinyl imidazole, polyethylene oxide, ethyl cellulose, methyl cellulose, an ethylene-acrylic-acid copolymer, casein, a polyamide, copolyamide, glue, or gelatin. It dissolves in the solvent suitable for each, and is applied on a conductive base material. The thickness is about 0.2-2 micrometers.

The photosensitive layer can be a laminated structure or a single layer structure. The laminated structure includes the charge generating layer containing the charge generating material and the charge transporting layer containing the chare transporting material. The single layer structure includes one layer containing the charging material and the transporting material.

The charge generating material can be a pyrylium, a thio pyrylium type pigment, a phthalocyanine pigment anthanthrone pigment, a dibenz pyrenequinone pigment, a pyran TRON pigment, a tris azo pigment, a disazo pigment, an azo pigment, an indigo pigment, a quinacridone type pigment, an unsymmetrical kino cyanine, or a kino cyanine.

It is preferred that a cross-linkage charge transport material is used as a charge transport material. A cross-linkage charge transport material can be a pyrene, a N-ethyl carbazole, a N-isopropylcarbazole, an N-methyl-N-phenyl hydrazino-3-methylidyne-9-ethyl carbazole, a N-N-diphenyl hydrazino-3-methylidyne-9-ethyl carbazole, a N-N-diphenyl hydrazino-3-methylidyne-10-ethyl phenothiazin, a N-N-diphenyl hydrazino-3-methylidyne-10-ethyl phenoxazine, a p-diethylamino benzaldehyde-N, a N-diphenyl hydrazone, a thoria reel methane type compounds, such as a p-diethylamino bends ARUDEHINO-2-methylphenyl-phenylmethane, a poly aryl alkanes, such as a 1,1-bis(4-N-N-diethylamino-2-methylphenyl) heptane, 1-1-2-2-tetrakis(4-N-N-dimethylamino-2-methylphenyl) ethane, or a thoria reel amines.

(Toner)

Toner having shape factor SF-1 from 100 to 150 is used to form a toner image on the surface of the image carrier. If the shape of toner is sphere-like, a contact state between toner and toner, and toner and the photosensitive member is a point contact, an adsorption between toners becomes weak; therefore, a fluidity of toner rises. Further, an adsorption between toner and the photosensitive member becomes weak; therefore, a transfer rate rises. When the shape factor SF-1 of the toner is greater than 150, a transfer rate from the sensitive member may decrease.

Figure 22:
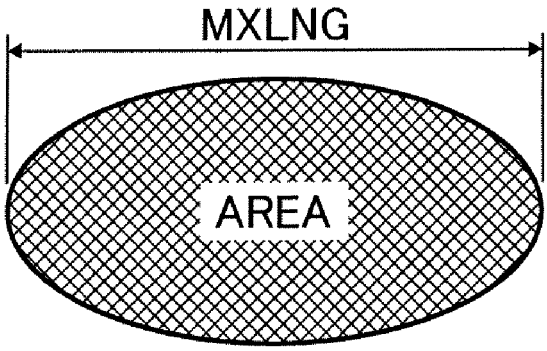
FIG. 22 illustrates the definition of shape-factor SF1 of toner.

Here, the shape factor SF-1 of toner is explained with reference to FIG. 22. The shape factor SF-1 indicates a degree of roundness of a spherical substance (e.g., a toner particle) and is represented by an equation 1 provided below. The shape factor SF-1 of the toner particle is calculated by squaring a maximum length MXLNG (i.e., MXLNG in the equation 1) of the toner particle projected on a two-dimensional plane and having an ellipse shape, dividing the squared value by an area AREA (i.e., AREA in the equation 1) of the projected toner particle, and multiplying the divided value by 100×π/4.

$$SF\text{-}1=(MXLNG2/\mathrm{AREA})\times(100\times\pi/4) \qquad \text{Equation 1}$$

Figure 23:
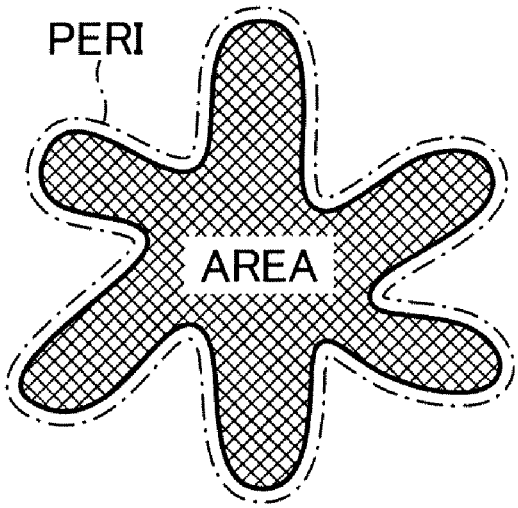
FIG. 23 illustrates the definition of shape-factor SF2 of toner.

The shape factor SF-2 of toner is explained with reference to FIG. 23. The shape factor SF-2 indicates a degree of unevenness of a spherical substance and is represented by an equation 2 provided below. The shape factor SF-2 of the toner is calculated by squaring a peripheral length PERI (i.e., PERI in the equation 2) of the toner particle projected on a two-dimensional plane and having an elliptical shape, dividing the squared value by an area AREA of the projected toner particle, and multiplying the divided value by 100×π/4.

$$SF\text{-}2=(PERI2/\mathrm{AREA})\times(100\times\pi/4) \qquad \text{Equation 2}$$

The shape factor SF-2 of toner is calculated by photographing toner at least 100 times by using a scanning electron microscope (S-800, manufactured by Hitachi Ltd.), and the image data are made by scanning the photographs with a scanner, and the image data are binarized and analyzed using an image analyzer (LUSEX 3 manufactured by Nireco Corp.).

Figure 24:
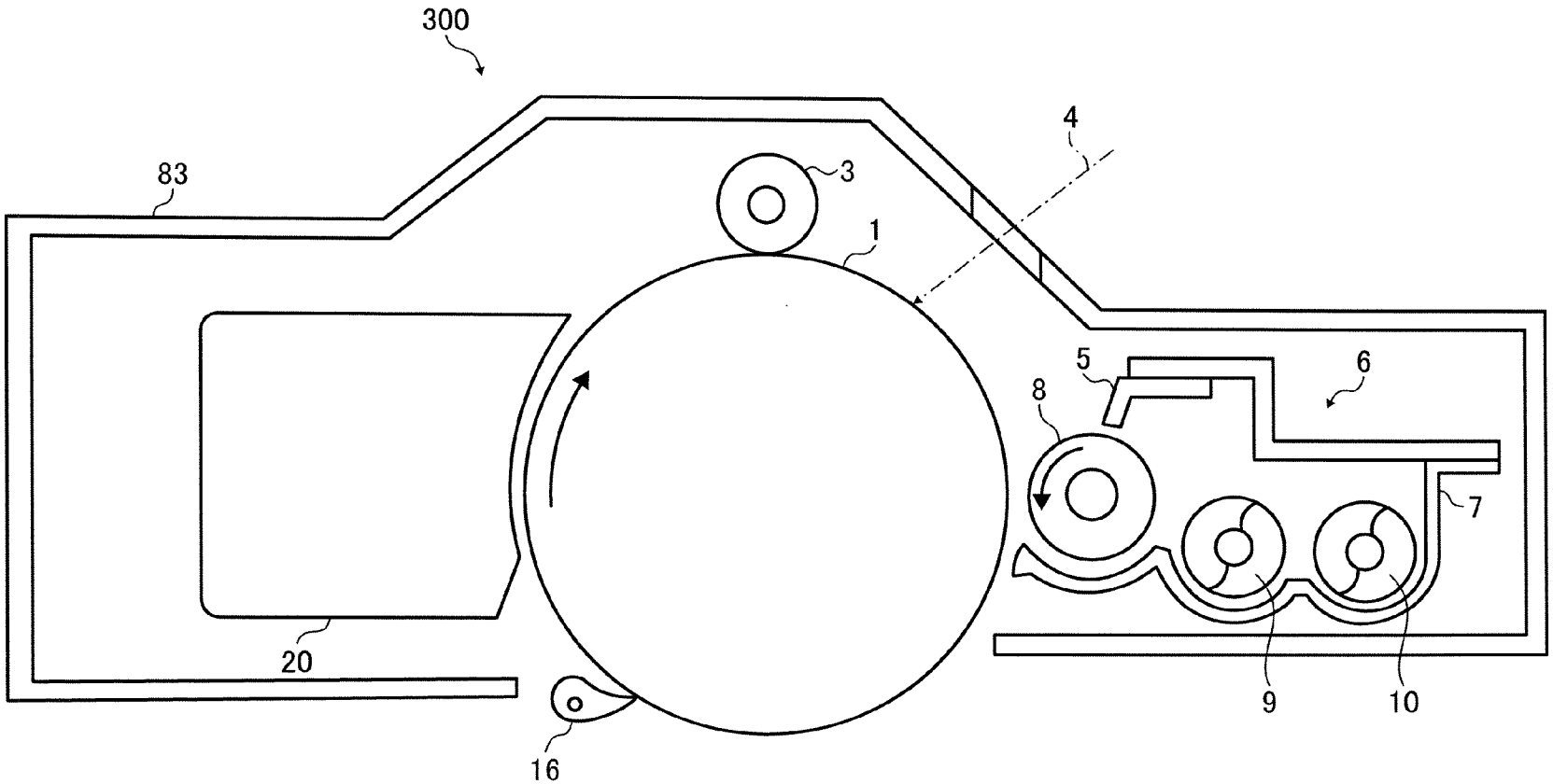
FIG. 24 is a schematic of a process cartridge according to an embodiment of the present invention.

FIG. 24 shows a process cartridge 300 including the photosensitive member 1 and the cleaning device 20 within a case 83. The process cartridge is detachably mounted to an image forming apparatus 100. However, the process cartridge 300 includes only a charging roller 3 and a developing device 6.

Figure 25:
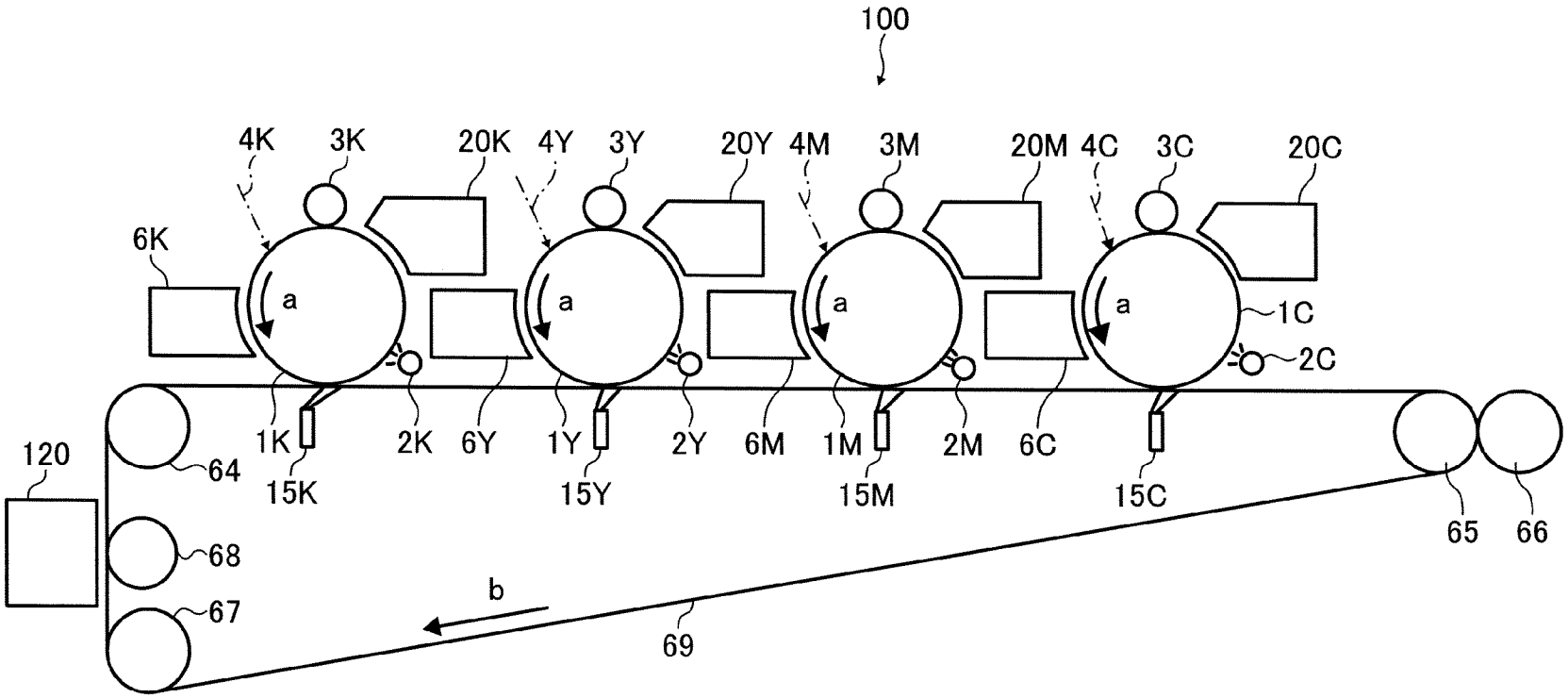
FIG. 25 is a schematic of a tandem type color image forming apparatus according to an embodiment of the present invention.
Figure 26:
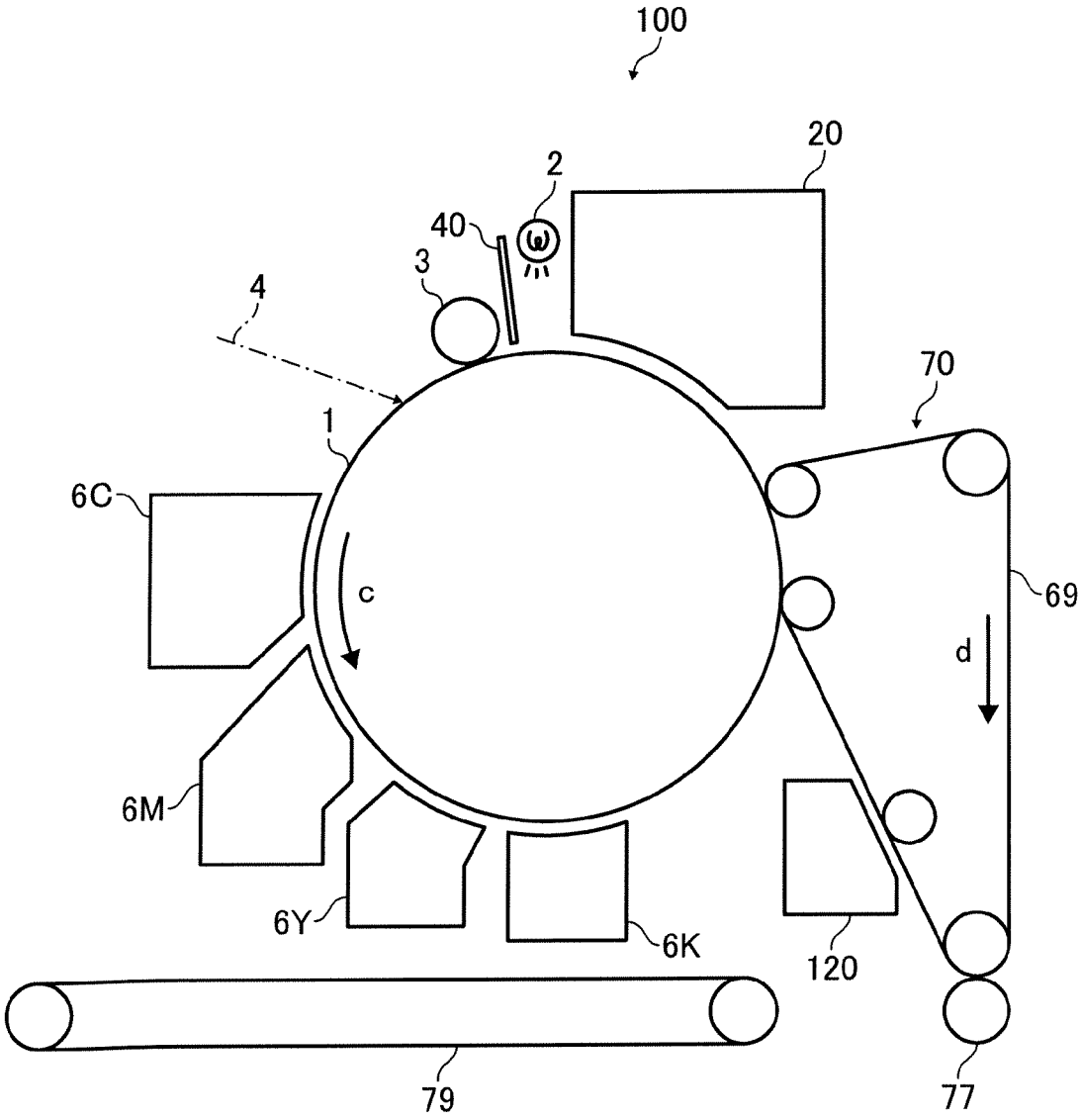
FIG. 26 is a schematic of a one drum type color image forming apparatus according to an embodiment of the present invention.

Referring to FIG. 25 and FIG. 26, a color image forming apparatus with a cleaning device 20 according to an exemplary embodiment of the present invention is illustrated. FIG. 25 illustrates a tandem type color image forming apparatus with the cleaning device 20 of the present invention. The image forming apparatus 100 includes an intermediate transfer belt 69, which is looped over rollers 64, 65, and 67. The intermediate transfer belt 69 moves in a direction reflected by arrow b illustrated in FIG. 25. Four image sensitive members 1Y, 1M, 1C and 1K are arranged along a flat surface of the intermediate transfer belt 69. Charging rollers 3Y, 3M, 3C and 3K serving as a charging unit, developing devices 6Y, 6M, 6C and 6K serving as a developing unit, discharging lamps 2Y, 2M, 2C and 2K, and cleaning devices 20Y, 20M, 20C and 20K are arranged around the photosensitive members 1Y, 1M, 1C and 1K, respectively. The image forming apparatus 100 includes a paper tray (not shown). The paper tray loads a plurality of sheets P serving as a recording medium.

An uppermost sheet P is fed to a registration roller pair. The registration roller pair feeds the sheet P toward a second transfer nip formed between a second transfer roller 25 and the intermediate transfer belt 69 at a proper time.

An image forming process of the image forming apparatus 100 illustrated in FIG. 25 is described below. The photosensitive members 1Y, 1M, 1C and 1K are rotated in a rotating direction a, and an intermediate transfer belt 69 is rotated in a rotating direction b. The charging rollers 3Y, 3M, 3C and 3K uniformly charge a surface of the photosensitive members 1Y, 1M, 1C and 1K. A laser beam 4, corresponding to image data onto the surface of the photosensitive member, is emitted on the surface of the photosensitive members 1Y, 1M, 1C and 1K, to form an electrostatic latent image on the photosensitive members 1Y, 1M, 1C and 1K, respectively. The electrostatic latent image on the photosensitive members 1Y, 1M, 1C and 1K are developed by the developing devices 6Y, 6M, 6C and 6K to form a toner image on the surface of the photosensitive members 1Y, 1M, 1C and 1K, respectively. The toner images formed on the surface of the photosensitive members 1Y, 1M, 1C and 1K are transferred and superimposed on the outer circumferential surface of the intermediate transfer belt 69. The superimposed toner images on the outer circumferential surface of the intermediate transfer belt 69 are transferred to the sheet P fed toward a second transfer nip formed between the intermediate transfer belt 69 and a second transfer roller 66. The sheet P bearing the superimposed toner images is fed to a fixing unit (not shown). The fixing unit applies heat and pressure to the sheet P bearing the superimposed toner images to fix the superimposed toner images on the sheet P. The sheet P fixed with the superimposed toner images is ejected to a sheet stacking tray (not shown). The cleaning devices 20Y, 20M, 20C and 20K remove residual toner remaining on the surface of the photosensitive member 1Y, 1M, 1C and 1K, respectively. An intermediate transfer belt cleaning device 120 removes residual toner remaining on the outer circumferential surface of the intermediate transfer belt 69. The cleaning device 20 is also applicable to the intermediate transfer belt cleaning device 120.

In the case of the tandem type color image forming apparatus illustrated in FIG. 25, the cleaning device 20 can remove residual toner remaining on the surface of the photosensitive member 1, even when a spherical toner is used to develop the electrostatic latent image. The cleaning device 20 can remove residual toner on the surface of the photosensitive member 1 even if most of the residual toner has a positive polarity because an environmental change or if most of the residual toner has a negative polarity because of an environmental change. If the cleaning device 20 is applied to the intermediate transfer belt cleaning device 120, the intermediate transfer belt cleaning device 120 can remove residual toner remaining on the outer circumferential surface of the intermediate transfer belt 69, even when a spherical toner is used to develop the electrostatic latent image. The intermediate transfer belt cleaning device 120 can remove residual toner remaining on the outer circumferential surface of the intermediate transfer belt 69 even if most of the residual toner has a positive polarity because of an environmental change or if most of the residual toner has a negative polarity because of an environmental change.

FIG. 26 illustrates a one drum type color image forming apparatus with the cleaning device 20 of the present invention. The image forming apparatus includes a photosensitive drum in a main body housing of the image forming apparatus 100. A charging roller 3, serving as a charging unit, developing devices 6C, 6M, 6Y, 6K corresponding to cyan, magenta, yellow and black colors, respectively, serving as a developing unit, an intermediate transfer belt 69, serving as an intermediate transfer unit, and a cleaning device 20, serving as a cleaning unit are arranged around the photosensitive member 1. The image forming apparatus 100 includes a paper tray (not shown). The paper tray loads a plurality of sheets P serving as a recording medium. An uppermost sheet P is fed to a registration roller pair. The registration roller pair feeds the sheet P toward a second transfer nip formed between a second transfer roller 77 and the intermediate transfer belt 70 at a proper time.

An image forming process using the image forming apparatus 100 illustrated in FIG. 26 is described below. The photosensitive member 1 moves in a direction of the arrow c illustrated in FIG. 26, and the intermediate transfer belt 69 moves in a direction of the arrow d illustrated in FIG. 26. The charging roller 3 uniformly charges a surface of the photosensitive member 1. The surface of the photosensitive member 1 is emitted by a laser beam 4 corresponding to image data of cyan color onto the surface of the photosensitive member 1 to form an electrostatic latent image on the photosensitive member 1. The electrostatic latent image of the cyan color on the photosensitive member 1 is developed by the developing device 6C to form a cyan toner image on the surface of the photosensitive member 1. The cyan toner images formed on the surface of the photosensitive member 1 are transferred on the outer circumferential surface of the intermediate transfer belt 69. After that, the cleaning device 20 removes residual toner remaining on the surface of the photosensitive member 1, and the charging roller 3 uniformly charges a surface of the photosensitive member 1 again. A laser beam 4 corresponding to image data of magenta color is emitted onto the surface of the photosensitive member 1 to form an electrostatic latent image on the photosensitive member 1. The electrostatic latent image of the magenta color on the photosensitive member 1 is developed by the developing device 6M to form a magenta toner image on the surface of the photosensitive member 1. The magenta toner images formed on the surface of the photosensitive member 1 are transferred and superimposed to the cyan color toner image on the outer circumferential surface of the intermediate transfer belt 69. In the same way, a yellow color toner image and a black color toner image are transferred and superimposed on the outer circumferential surface of the intermediate transfer belt 69. The superimposed toner images on the outer circumferential surface of the intermediate transfer belt 69 are transferred to the sheet P fed toward a second transfer nip formed between the intermediate transfer belt 69 and a second transfer roller 77. The sheet P bearing the superimposed toner images is fed to a fixing unit (not shown) by a sheet transfer belt 79. The fixing unit applies heat and pressure to the sheet P bearing the superimposed toner images to fix the superimposed toner images on the sheet P. The sheet P fixed with the superimposed toner images is ejected to a sheet stacking tray (not shown). The cleaning device 20 removes residual toner remaining on the surface of the photosensitive member 1. An intermediate transfer belt cleaning device 120 removes residual toner remaining on the outer circumferential surface of the intermediate transfer belt 69. The cleaning device 20 is also applicable to the intermediate transfer belt cleaning device 120.

In the case of the one drum type color image forming apparatus illustrated in FIG. 26, the cleaning device 20 can remove residual toner remaining on the surface of the photosensitive member 1, even when a spherical toner is used to develop the electrostatic latent image. The cleaning device 20 can remove residual toner on the surface of the photosensitive member 1 even if most of the residual toner has a positive polarity because of an environmental change or most of the residual toner has a negative polarity because of an environmental change. If the cleaning device 20 is applied to the intermediate transfer belt cleaning device 120, the intermediate transfer belt cleaning device 120 can remove residual toner remaining on the outer circumferential surface of the intermediate transfer belt 69, even when a spherical toner is used to develop the electrostatic latent image. The intermediate transfer belt cleaning device 120 can remove residual toner remaining on the outer circumferential surface of the intermediate transfer belt 69 even if most of the residual toner has a positive polarity because of an environmental change or if most of the residual toner has a negative polarity because of an environmental change.

Figure 27:
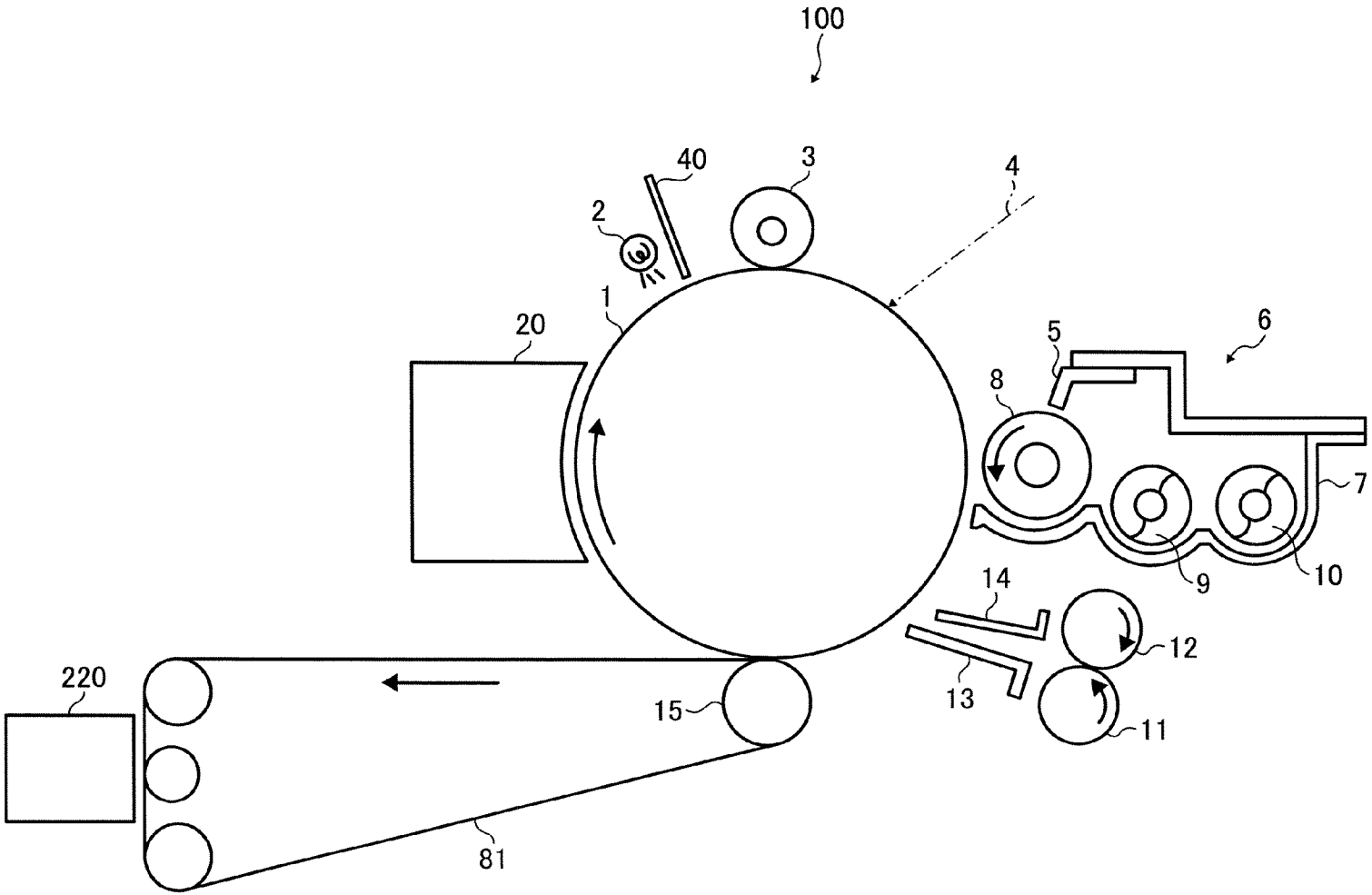
FIG. 27 is a schematic of a sheet transfer belt of an image forming apparatus according to an embodiment of the present invention.

Referring to FIG. 27, a structure of a sheet transfer belt with the cleaning device 20 according to an exemplary embodiment of the present invention illustrated. If the sheet P gets jammed, the toner images on the surface of the photosensitive member 1 are transferred to the sheet transfer belt 81. There is a case that toner which has less quantity of charge or is charged with a positive polarity on the surface of the developing roller 8 is transferred to the portion of the surface of the photosensitive member 1 between a sheet P and a second sheet P. This toner on the surface of the photosensitive member 1 is transferred to the sheet transfer belt 81. A portion of this toner on the sheet transfer belt 81 is injected with charges by the transfer roller 15, and a reversal of polarity of this portion of toner occurs. Thus, toner, which has a positive polarity, and toner, which has a negative polarity, coexist on the surface of the sheet transfer belt 81. In the case of the sheet transfer belt illustrated in FIG. 27, the cleaning device 20, serving as a sheet transfer belt cleaning device 220, can remove residual toner remaining on the surface of the sheet transfer belt 81, although toner, which has a positive polarity, and toner, which has a negative polarity, coexists on the surface of the sheet transfer belt 81.

The embodiments discussed above utilize a cleaning device including a cleaning brush which is applied a voltage and removes a toner, wherein the cleaning brush is made of a fiber, wherein an inside part of the fiber is formed from a conductive material, a surface part of the fiber is formed form an insulative material, and the conductive cleaning blade is applied a voltage. However the present invention is not limited to such a cleaning device. For example, according to another embodiment, the cleaning device includes a cleaning brush which is applied a voltage and removes a toner, wherein the cleaning brush is made of a fiber, an inside part of the fiber is formed from a conductive material, and a surface part of the fiber is formed form an insulative material.

According to an additional embodiment, a cleaning device can be two cleaning brushes having opposite voltages applied respectively, and a cleaning blade applied the voltage. In this case, the cleaning brush which contracts the toner first should be made of a fiber wherein an inside part of the fiber is formed from a conductive material and a surface part of the fiber is formed by an insulating material.

Numerous additional modifications and variations are possible in light of the above teachings. It is therefore to be understood that within the scope of the appended claims, the disclosure of this patent specification may be practiced otherwise than as specifically described herein.

The invention claimed is:

1. A cleaning device installed in an image forming apparatus, comprising:

a cleaning brush to remove toner from a surface of a member of the image forming apparatus;

wherein the cleaning brush includes a plurality of fibers having an inside part formed from a conductive material and a surface part including an end face of a tip of the fiber only formed by an insulating material.

2. The cleaning device according to claim 1, wherein:

the fibers are curved, radiate from the axis of the cleaning brush, and the tips extend in a direction reverse to a rotating direction of the cleaning brush.

3. The cleaning device according to claim 1, further comprising:

a cleaning member configured to remove the toner from the surface of the fibers of the cleaning brush.

4. The cleaning device according to claim 1, further comprising:

a conductive cleaning blade configured to clean the surface of the member, wherein any residual toners remaining on the member after the conductive cleaning blade has contacted the member are removed by the cleaning brush.

5. The cleaning device according to claim 1, wherein:

the toner is spherical.

6. The cleaning device according to claim 5, wherein:

the toner has a shape factor SF-1 of from 100 to 150.

7. A process cartridge detachably attached an image forming apparatus, comprising:

a photosensitive member configured to form an image using toner provided on a surface thereof; and a cleaning device including a cleaning brush configured to remove the toner on the photosensitive member;

wherein the cleaning brush includes a plurality of fibers having an inside part formed from a conductive material and a surface part including an end face of a tip of the fiber only formed by an insulating material.

8. The process cartridge according to claim 7, wherein:

the fibers are curved, radiate from the axis of the brush, and the tips extend in a direction reverse to a rotating direction of the cleaning brush.

9. The process cartridge according to claim 7, further comprising:

a cleaning member configured to remove the toner from the surface of the fibers of the cleaning brush.

10. The process cartridge according to claim 7, further comprising:

a conductive cleaning blade configured to clean the surface of the photosensitive member, wherein any residual toners remaining on the photosensitive member after the conductive cleaning blade has contacted the photosensitive member are removed by the cleaning brush.

11. The process cartridge according to claim 7, wherein:

the photosensitive member has a photoconductive layer including amorphous silicon.

12. The process cartridge according to claim 7, wherein:

a surface layer of the photosensitive member includes a filler.

13. The process cartridge according to claim 7, wherein:

a charge transporting layer of the photosensitive member includes a cross-linkage charge transport material.

14. An image forming apparatus, comprising:

a photosensitive member configured to form an image using a toner provided on a surface thereof; and a cleaning device including a cleaning brush configured to remove a toner on the photosensitive member;

wherein the cleaning brush includes a plurality of fibers having an inside part formed from a conductive material and a surface part including an end face of a tip of the fiber only formed by an insulating material.

15. The image forming apparatus according to claim 14, wherein:

the fibers are curved, radiate from the axis of the brush, and the tips extend in a direction reverse to a rotating direction of the cleaning brush.

16. The image forming apparatus according to claim 14, further comprising:

a cleaning member configured to remove the toner from the surface of the fibers of the cleaning brush.

17. The image forming apparatus according to claim 14, further comprising:

a conductive cleaning blade configured to clean the surface of the photosensitive member, wherein any residual toners remaining on the photosensitive member after the conductive cleaning blade has contacted the photosensitive member are removed by the cleaning brush.

18. The image forming apparatus according to claim 14, further comprising:

a plurality of developing devices, each developing device configured to develop toners having different colors, wherein the plurality of the developing devices face the photosensitive member.

19. The image forming apparatus according to claim 14, further comprising:

a plurality of developing devices, each developing device configured to develop toners having different colors, wherein the apparatus includes a plurality of the photosensitive members, and the plurality of developing devices face the plurality of the photosensitive members, respectively.

* * * * *

UNITED STATES PATENT AND TRADEMARK OFFICE

CERTIFICATE OF CORRECTION

PATENT NO. : 7,809,321 B2
APPLICATION NO. : 11/866518
DATED : October 5, 2010
INVENTOR(S) : Hidetoshi Yano et al.

It is certified that error appears in the above-identified patent and that said Letters Patent is hereby corrected as shown below:

On the title page, Item (75), the fifth inventor's first name is incorrect. Item (75) should read:

-- (75) Inventors: Hidetoshi Yano, Kanagawa (JP); Osamu Naruse, Kanagawa (JP); Kenji Sugiura, Kanagawa (JP); Naomi Sugimoto, Kanagawa (JP); Yasuyuki Yamashita, Kanagawa (JP) --

Signed and Sealed this
Twenty-fifth Day of January, 2011

David J. Kappos

David J. Kappos
*Director of the United States Patent and Trademark Office*